US006653783B2

(12) United States Patent
Kawasaki et al.

(10) Patent No.: US 6,653,783 B2
(45) Date of Patent: Nov. 25, 2003

(54) SELF-BALLASTED ELECTRODELESS DISCHARGE LAMP WITH STARTABILITY IMPROVING MEANS

(75) Inventors: Mitsuharu Kawasaki, Kadoma (JP); Toshiaki Kurachi, Hirakata (JP); Koji Miyazaki, Hirakata (JP); Kiyoshi Hashimotodani, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 94 days.

(21) Appl. No.: 09/963,087

(22) Filed: Sep. 25, 2001

(65) Prior Publication Data

US 2002/0036467 A1 Mar. 28, 2002

(30) Foreign Application Priority Data

Sep. 26, 2000 (JP) ..... 2000-292030

(51) Int. Cl.[7] ..... H01J 65/00

(52) U.S. Cl. ..... 313/609; 313/607; 313/234; 315/248

(58) Field of Search ..... 313/609, 607–610, 313/634, 635, 234; 315/248

(56) References Cited

U.S. PATENT DOCUMENTS 2,947,901 A * 8/1960 Haddad ..... 313/157
4,728,867 A * 3/1988 Postma et al. ..... 315/248
5,630,958 A * 5/1997 Stewart et al. ..... 219/670
5,801,493 A * 9/1998 Antonis et al. ..... 315/248
6,249,090 B1 * 6/2001 Popov et al. ..... 315/248
6,380,680 B1 * 4/2002 Troxler ..... 313/607
6,433,478 B1 * 8/2002 Chandler et al. ..... 313/607
6,522,084 B1 * 2/2003 Miyazaki et al. ..... 315/248

FOREIGN PATENT DOCUMENTS

JP 60136159 A * 7/1985 ..... H01J/65/04
JP 61096649 A * 5/1986 ..... H01J/65/04
JP 07021995 A 1/1995

* cited by examiner

*Primary Examiner*—Nimeshkumar D. Patel
*Assistant Examiner*—Sikha Roy
(74) *Attorney, Agent, or Firm*—Harness, Dickey & Pierce, P.L.C.

(57) ABSTRACT

An electrodeless discharge lamp includes a translucent bulb enclosing a luminous material; a coil for generating an alternating magnetic field that causes discharge in the luminous material; a power source for supplying an alternating current to the coil, the coil including a core and a winding provided near the bulb; and further includes startability improving means for improving startability of the lamp by generating a portion in which the alternating magnetic field generated by the coil is intensified in the bulb.

15 Claims, 16 Drawing Sheets

SELF-BALLASTED ELECTRODELESS DISCHARGE LAMP WITH STARTABILITY IMPROVING MEANS

BACKGROUND OF THE INVENTION

The present invention relates to electrodeless discharge lamps. In particular, the present invention relates to electrodeless discharge lamps in which a coil is provided inside a bulb.

Some discharge lamps are electrodeless discharge lamps that do not include electrodes. Since electrodeless discharge lamps do not include electrodes, they advantageously have a longer life than that of discharge lamps including electrodes that ends their life by depletion of an electron release material on the electrodes. The electrodeless discharge lamps emit light in an ultraviolet ray range or visible light range by the following operation. A high frequency alternating magnetic field, for example, from 50 kH to 50 MHz is generated by a coil, and luminous gases such as a rare gas, mercury, metal halide and the like enclosed in a bulb are excited by an induction field generated by the high frequency alternating magnetic field. The excitation of the luminous gas provides light emission in an ultraviolet ray range or a visible light range. Emitted light in an ultraviolet ray range can be converted to light in a visible light range by phosphors.

FIGS. 16A and 16B are schematic views showing the configuration of a conventional electrodeless discharge lamp. FIG. 16A is a cross-sectional view including the central axis of a core 1106, and FIG. 16B is a cross-sectional view taken along a line X–X'.

Referring to FIGS. 16A and 16B, the configuration and the operation of the conventional electrodeless discharge lamp will be described. This conventional electrodeless discharge lamp is a lamp whose light is started and maintained by a high frequency alternating magnetic field generated in the vicinity of a coil, and is a (compact) self-ballasted electrodeless discharge lamp to which a lamp base 1101 is integrated.

The electrodeless discharge lamp shown in FIGS. 16A and 16B includes a lamp base 1101, a power source (not shown) disposed inside a power source portion 1102, and a translucent bulb 1104 in which a cavity 1105 is provided. A coil in which a winding 1103 winds around a cylindrical core 1106 is inserted in the cavity 1105. The lamp base 1101 and the power source in the power source portion 1102 are electrically connected to each other, and the power source and the winding 1103 are also electrically connected to each other. In FIG. 16A, for clarification of the drawing, the vicinity of the central axis of the core 1106 and the lines of magnetic force (dotted lines) are shown in cross section, and the lamp base 1101, the power source portion 1102, the bulb 1104 are shown in their outlook.

When a commercial alternating current power is supplied to the power source (not shown) in the power source portion 1102 via the lamp base 1101, the power source portion 1102 converts the commercial alternating current power to a high frequency alternating current power, and supplies it to the winding 1103. The winding 1103 that has been supplied with the high frequency alternating current power forms a high frequency alternating magnetic field as shown by lines of magnetic force o in a space near the coil. When a high frequency alternating magnetic field is formed, an induction field orthogonal to the high frequency alternating magnetic field is generated, and then luminous gases in the bulb 1104 are excited and light is emitted. As a result, light in an ultraviolet ray range or a visible light range can be obtained.

However, the configuration of the conventional electrodeless discharge lamp shown in FIGS. 16A and 16B has the following problems. In the conventional configuration, the high frequency alternating magnetic field radiated from the coil as shown in the lines of magnetic force o leaks out from the bulb 1104, so that the magnetic field inside the bulb 1104 is reduced. As a result, the induction field formed by the magnetic field is reduced, which makes it difficult to start the lamp. In particular, when the ambient temperature is low, the startability of the lamp is significantly poor.

SUMMARY OF THE INVENTION

Therefore, with the foregoing in mind, it is an object of the present invention to provide an electrodeless discharge lamp with improved startability.

An electrodeless discharge lamp of the present invention includes a translucent bulb enclosing a luminous material; a coil for generating an alternating magnetic field that causes discharge in the luminous material; a power source for supplying an alternating current to the coil, the coil including a core and a winding provided near the bulb; and further includes startability improving means for improving startability of the lamp by generating a portion in which the alternating magnetic field generated by the coil is intensified in the bulb.

In one preferred embodiment, the coil is inserted in a cavity provided in the bulb.

In one preferred embodiment, the electrodeless discharge lamp further includes a phosphor applied onto the inner surface of the bulb.

In one preferred embodiment, the luminous material includes mercury and a rare gas.

In one preferred embodiment, the startability improving means is constituted by providing a high permeability member including a soft magnetic material near the core.

In one preferred embodiment, the high permeability member is provided in the bulb.

In one preferred embodiment, the high permeability member is a magnetic thin film provided on a surface of the bulb.

In one preferred embodiment, the high permeability member is plate-shaped and is inserted between the power source and the bulb.

In one preferred embodiment, the plate-shaped high permeability member has an asymmetric shape in which it is not symmetric with respect to the central axis of the core.

In one preferred embodiment, the plate-shaped high permeability member has a circular plate-like shape.

In one preferred embodiment, the center of the circle of the circular plate-shaped high permeability member is positioned in a portion other than the central axis of the core.

In one preferred embodiment, the high permeability member has such a U-shaped cross-section that the high permeability member surrounds the bottom of the bulb positioned on the side of the power source and a part of the side face adjacent to the bottom.

In one preferred embodiment, the high permeability member has at least one protrusion, recess or notch.

In one preferred embodiment, the startability improving means is constituted by the coil in which the winding density of the winding wound around the core is sparse on the side of the power source and is dense on the side opposite to the power source.

In one preferred embodiment, the startability improving means is constituted by the coil in which cross-section areas of the core are different along the central axis of the core.

In one preferred embodiment, the startability improving means is constituted by the coil provided with the core made of two or more magnetic materials having different magnetic permeabilities.

In one preferred embodiment, the electrodeless discharge lamp of the present invention is constituted as a self-ballasted electrodeless discharge lamp further including a lamp base electrically connected to the power source.

According to another aspect of the present invention, another electrodeless discharge lamp of the present invention includes a bulb made of a translucent material and filled with a luminous material inside the bulb; a coil including a core and a winding disposed near the bulb; and a power source for supplying a high frequency alternating current power to the winding. The electrodeless discharge lamp has a configuration in which discharge inside the bulb is caused by a high frequency alternating magnetic field formed by the coil, and the high frequency alternating magnetic field inside the bulb is distributed non-uniformly at the cross-section orthogonal to the central axis of the core.

According to another aspect of the present invention, yet another electrodeless discharge lamp includes a bulb made of a translucent material and filled with a luminous material inside the bulb; a coil including a core and a winding disposed near the bulb; and a power source for supplying a high frequency alternating current power to the winding. The electrodeless discharge lamp has a configuration in which discharge inside the bulb is caused by a high frequency alternating magnetic field formed by the coil, and the distribution of the high frequency alternating magnetic field inside the bulb is deviated to a direction opposed to the power source at a cross-section including a central axis of the core.

In one preferred embodiment, a magnetic member including soft magnetic material is provided near the core or integrally with the core.

According to another aspect of the present invention, a self-ballasted electrodeless discharge lamp of the present invention includes a translucent bulb enclosing a luminous material; an induction coil for generating an alternating magnetic field that causes discharge in the luminous material; a power source for supplying an alternating current to the induction coil; and a lamp base electrically connected to the power source. The induction coil includes a core and a winding provided near the bulb, and is inserted in a cavity provided in the bulb, a phosphor is applied onto an inner surface of the bulb, and a member including soft magnetic material is provided near the induction coil.

According to another aspect of the present invention, another electrodeless discharge lamp includes a translucent bulb enclosing a luminous material; an induction coil for generating an alternating magnetic field that causes discharge in the luminous material; a power source for supplying an alternating current to the induction coil; and a lamp base electrically connected to the power source. The induction coil includes a core and a winding provided near the bulb, and is inserted in a cavity provided in the bulb, a phosphor is applied onto an inner surface of the bulb, and the induction coil has a configuration that forms a dense portion in a distribution of the alternating magnetic field occurring in the bulb.

According to the electrodeless discharge lamp of the present invention, startability improving means for improving the startability of the lamp by producing a portion in which the alternating magnetic field generated by a coil is intensified in a bulb is provided. Thus, the startability of the lamp can be improved. In particular, the poor startability at low temperatures can be improved, so that an electrodeless discharge lamp that can be effectively used even under low temperature environments can be provided. In the case where the electrodeless discharge lamp of the present invention is constituted as a self-ballasted electrodeless discharge lamp, a commercial alternating current power can be supplied to the power source through the lamp case. Therefore, a lamp that is easy to handle can be provided.

The startability improving means can be constituted, for example, by providing a high magnetic permeability member including soft magnetic material near the core. Moreover, the startability improving means can be constituted by a coil in which the winding density of the winding wound around the core is sparse on the side of the power source and is dense on the side opposite to the power source. Furthermore, the startability improving means can be constituted by the coil having different cross-section areas of the core along the central axis of the core. In addition, the startability improving means can be constituted by the coil including a core made of two or more magnetic materials having different magnetic permeabilities.

This and other advantages of the present invention will become apparent to those skilled in the art upon reading and understanding the following detailed description with reference to the accompanying figures.

DETAILED DESCRIPTION OF THE INVENTION

Figure 1A:
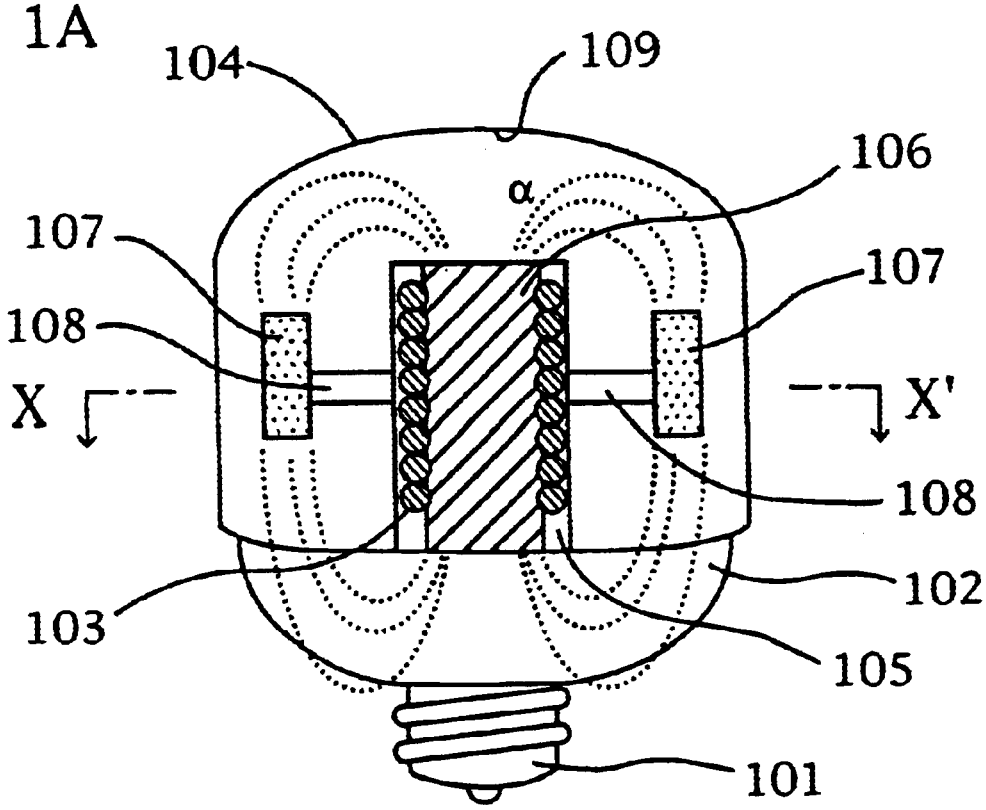
FIG. 1A is a cross-sectional view taken along the central axis of a cylindrical core showing the configuration of an electrodeless discharge lamp of Embodiment 1 of the present invention.

The inventors of the present invention conducted studies and research to improve poor startability of an electrodeless discharge lamp and then found that the startability can be improved comparatively simply by restricting spatial spread of the magnetic field formed by a coil and concentrating the magnetic field on a part of a discharge space to provide a portion having a high electric field intensity. Thus, the present invention can be attained.

Hereinafter, embodiments of the present invention will be described with reference to the accompanying drawings. For simplification, in the following drawings, components having substantially the same function bear the same reference numeral. The present invention is not limited to the following embodiments.

Embodiment 1

An electrodeless discharge lamp of Embodiment 1 of the present invention will be described with reference to FIGS. 1A and 1B to 3A and 3A.

Figure 1B:
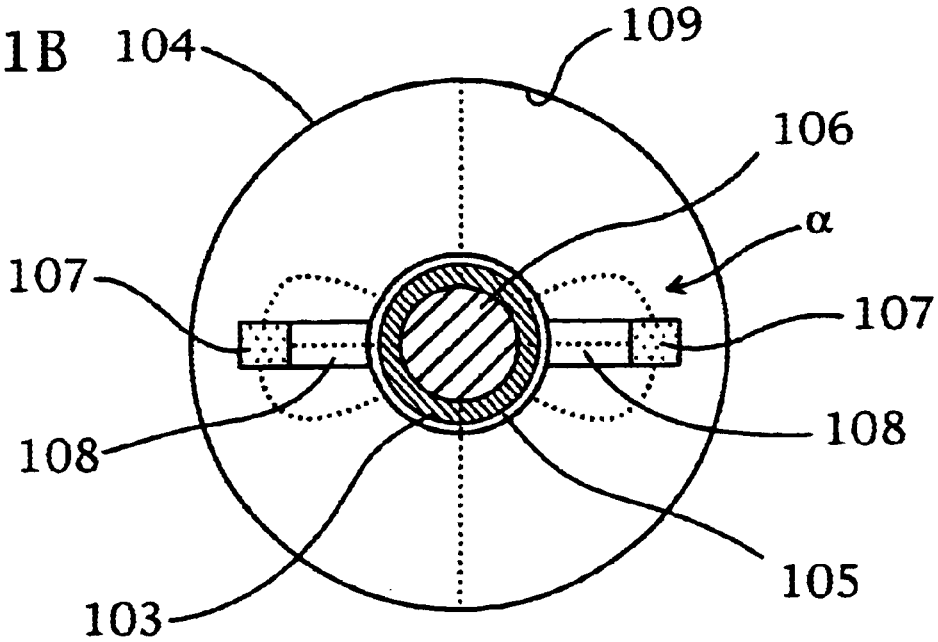
FIG. 1B is a cross-sectional view taken along a line (X–X') that is orthogonal to the central axis of the cylindrical core showing the configuration of the electrodeless discharge lamp of FIG. 1A.

First, FIGS. 1A and 1B are referred to. FIGS. 1A and 1B schematically show the configuration of an electrodeless discharge lamp of this embodiment. FIG. 1A is a cross-sectional view including the central axis of a cylindrical core 106, and FIG. 1B is a cross-sectional view taken along a line X–X' in FIG. 1A.

The electrodeless discharge lamp shown in FIGS. 1A and 1B includes a translucent bulb (discharge vessel) 104 enclosing luminous materials, an induction coil including a core (106) and a winding (103), and a power source portion 102 housing a power source (not shown) for supplying alternating current to the induction coil in its inside. The power source portion 102 may be referred to simply as a power source and the induction coil (106 and 103) may be referred to simply as a coil. A lamp base 101 is attached to a lower portion of the power source portion 102, and the power source in the power source portion 102 is electrically connected to the lamp base 101. In other words, this electrodeless discharge lamp is a (compact) self-ballasted electrodeless discharge lamp that allows a commercial alternating current power to be supplied to its power source via the lamp base 101. In FIG. 1A, for clarification of the drawing, the vicinity of the central axis of the core 106 and the lines of magnetic force (dotted lines) are shown in cross section, and the lamp base 101, the power source portion 102, the bulb 104 are shown in their outlook.

The bulb 104 is a bulb enclosing luminous material (e.g., luminous gas including mercury and a rare gas) inside, and a phosphor layer obtained by applying a phosphor 109, is formed on the inner surface of the bulb 104. In this embodiment, 1 to 10 mg of mercury (or mercury vapor or amalgam) and 10 to 250 Pa of argon gas are enclosed in the bulb 104 having an inner volume of 100 to 2500 $cm^3$. A cavity (recess) 105 for accommodating a coil (106 and 103) is provided in a portion of the bulb 104 on the side of the power source portion 102. In this cavity 105, the cylindrical core 106 is inserted. In other words, the coil (106 and 103) is inserted in the cavity 105, and disposed near the bulb 104. The core 106 in FIGS. 1A and 1B is solid, but the cylindrical core can be hollow.

The core 106 is made of, for example, Mn—Zn based ferrite, and the winding 103 is wound around the outer circumference of the core 106. The winding 103 is electrically connected to the power source in the power source portion 102, more specifically, connected to the output terminal of the power source portion 102. It is preferable that the core 106 is thermally connected to the case of the power source portion 102 for housing the power source to increase heat release.

The electrodeless discharge lamp of this embodiment includes means (107) for producing a portion having a high intensity of the alternating magnetic field generated by the coil (106 and 103) (a portion in which alternating magnetic field is dense) in the bulb 104 to improve the startability of the lamp. In this embodiment, this means (107) may be referred to as startability improving means.

In the configuration shown in FIGS. 1A and 1B, the startability improving means (107) is constituted by a high magnetic permeability member (107) provided near the core 106. The high magnetic permeability member 107 is a member including soft magnetic material. The soft magnetic material has the property that the orientation of the magnetization is changed to the orientation of a magnetic field applied from outside, and has a large magnetic permeability. One example of the soft magnetic materials is soft ferrite (e.g., spinel ferrite). The high magnetic permeability member 107 of this embodiment is a magnetic member made of soft ferrite, and it is preferable that soft ferrite constituting the high magnetic permeability member 107 has a relative magnetic permeability of 1000 or more (e.g., about 1000 to 5000). Examples of soft ferrite include Mn—Zn based ferrites and Ni—Zn based ferrites. The high magnetic permeability members (startability improving means) 107 are provided in the discharge space of the bulb 104 via a supporting rod 108. There is no particular limitation regarding the material of the supporting rod 108, and metals, ceramics, plastics and the like can be used.

Next, the operation of the electrodeless discharge lamp of this embodiment will be described. When a commercial alternating current power is supplied to the power source portion 102 via the lamp base 101, the power source portion 102 converts the commercial alternating current power to a high frequency alternating current power, and supplies it to the winding 103. The frequency supplied by the power source portion 102 is, for example, 50 to 500 kHz, and the power to be supplied is, for example, 5 to 200 W. When the high frequency alternating magnetic field is supplied to the winding 103, the coil (106 and 103) forms a high frequency alternating magnetic field in the space near the coil. Then, an induction field orthogonal to the high frequency alternating magnetic field is generated, and luminous gas inside the bulb 104 is excited for light emission. As a result, light in an ultraviolet ray range or a visible light range is emitted. The emitted light in the ultraviolet ray range is converted to light in a visible light range (visible light) by a phosphor layer formed over the inner wall of bulb 104. It is possible to constitute a lamp employing light in an ultraviolet ray range (or light in a visible light range) as it is without forming a phosphor layer. The emission of light in the ultraviolet ray range results mainly from mercury. More specifically, in the case where a high frequency current flows through the coil (106 and 103) located close to the bulb 104, the magnetic field formed by the lines of magnetic force α due to electromagnetic induction cause mercury atoms and electrons in the bulb 104 to collide, so that ultraviolet rays are produced from exited mercury atoms.

Herein, the frequency of alternating current supplied by the power source portion 102 will be described. In this embodiment, the frequency of alternating current supplied by the power source portion 102 is in a relatively low frequency region such as 1 MHz or less (e.g., 50 to 500 kHz), compared with 13.56 MHz or several MHz in the ISM band, which is generally used in practice. The reason why the frequency in this low frequency region is used is as follows. First, in operation in a comparatively high frequency region such as 13.56 MHz or several MHz, a noise filter for suppressing line noise generated from a high frequency power source circuit in the power source portion 102 is large, so that the volume of the high frequency power source circuit (or the power source portion 102) becomes large. Furthermore, in the case where noise that is radiated or propagated from the lamp is high frequency noise, a strict regulation for high frequency noise is stipulated by the law. Therefore, in order to meet the regulation, it is necessary to provide an expensive shield, which is detrimental to reduction of the cost. On the other hand, in operation in a frequency region of about 1 MHz to 50 kHz, as the member constituting the high frequency power source circuit, it is possible to use an inexpensive article for general purposes that is used for an electronic component for general electronic equipment. In addition, it is possible to use a small member, and therefore a reduction in the cost and compactness can be achieved, which provides a large advantage. However, the electrodeless discharge lamp of this embodiment can be operated not only at 1 MHz or less, but also in a frequency region of 13.56 MHz or several MHz.

Figure 16A:
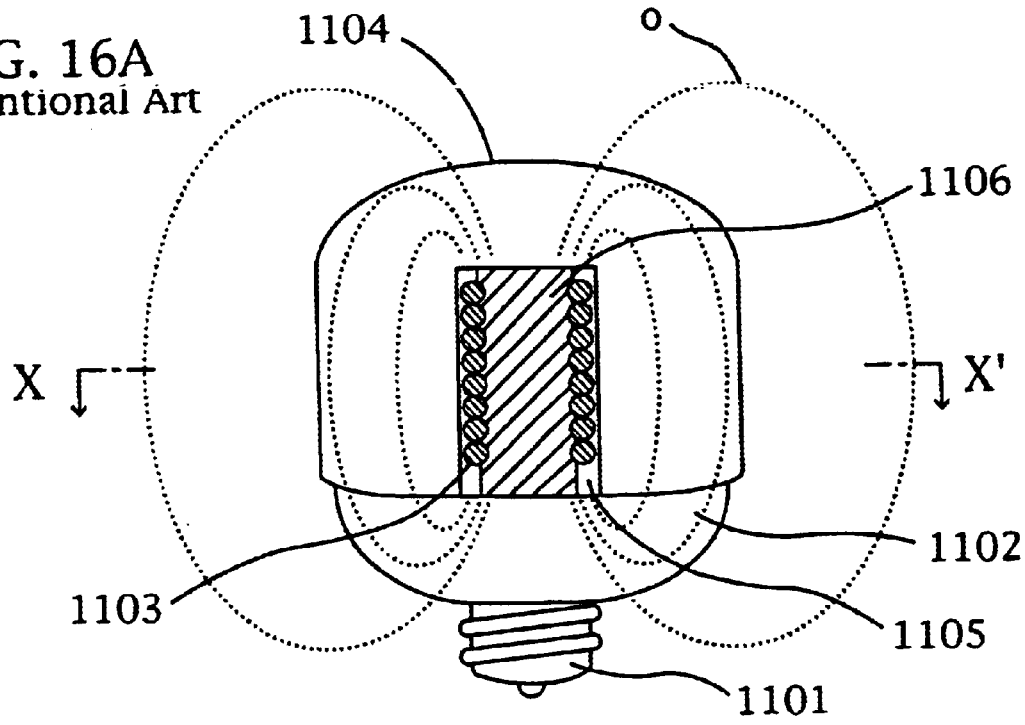
FIG. 16A Conventional Art
FIG. 16A is a cross-sectional view taken along the central axis of a cylindrical core showing the configuration of a conventional electrodeless discharge lamp.
Figure 16B:
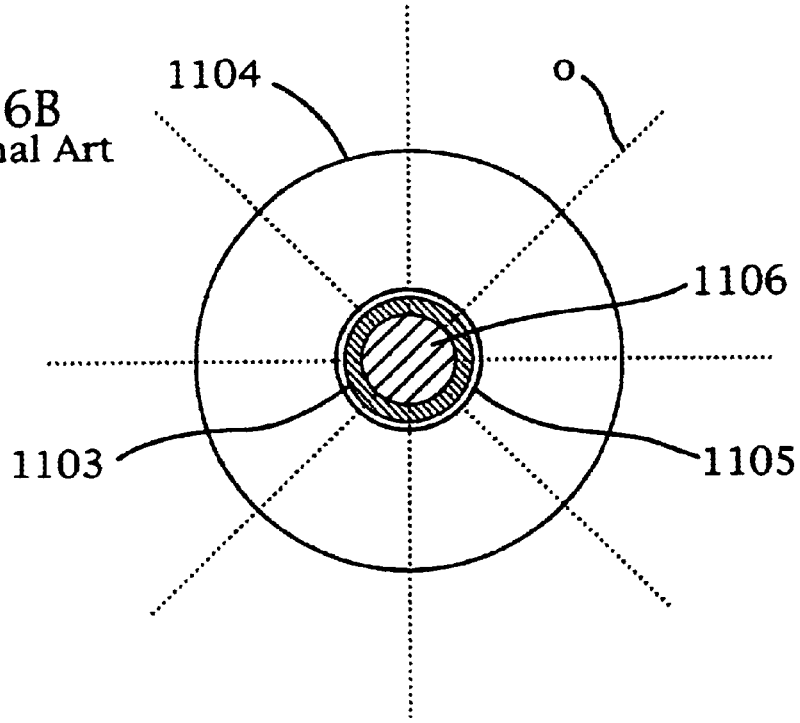
FIG. 16B Conventional Art
FIG. 16B is a cross-sectional view taken along a line (X–X') that is orthogonal to the central axis of the cylindrical core showing the configuration of the electrodeless discharge lamp of FIG. 16A.

In the electrodeless discharge lamp of this embodiment, the high magnetic permeability members 107 are provided near the core 106 (or coil), and therefore the high frequency alternating magnetic field selectively permeates the high magnetic permeability members 107. In other words, since the high frequency alternating magnetic field selectively passes through a material having a high permeability, the high frequency alternating magnetic field formed by the coil (106 and 103) selectively passes through the high magnetic permeability members 107 and becomes dense in the vicinity of the high magnetic permeability members 107, as shown by the lines of magnetic force α in FIGS. 1A and 1B. As a result, an induction field occurring orthogonally to the high frequency alternating magnetic field becomes intense in the vicinity of the high magnetic permeability members 107, so that the action of the locally intensified electric field excites argon gas and mercury easily, which makes it easy for discharge to occur. That is to say, the configuration shown in FIGS. 1A and 1B causes discharge to occur more readily than the conventional configuration without the high magnetic permeability members 107 as shown in FIGS. 16A and 16B. This means that the startability can be improved.

Describing more specifically, the lines of magnetic force o in the configuration shown in FIGS. 16A and 16B have a spatial spread. On the other hand, in the configuration shown in FIGS. 1A and 1B, because it has the high magnetic permeability members 107, the curvature of the lines of magnetic force α is smaller than that of the lines of magnetic force o, and the special spread of the lines of magnetic force α is restricted. Furthermore, the distribution of the lines of magnetic force α can be locally concentrated in the bulb 104. If it is possible to cause discharge easily even in one portion in the bulb 104, the discharge in that portion triggers discharge to occur entirely inside the bulb 104 smoothly. Therefore, the high magnetic permeability members 107 serve to improve the startability. Thus, with a comparatively simple configuration obtained by providing the high magnetic permeability members 107, the startability of the electrodeless discharge lamp can be improved.

Figure 2A:
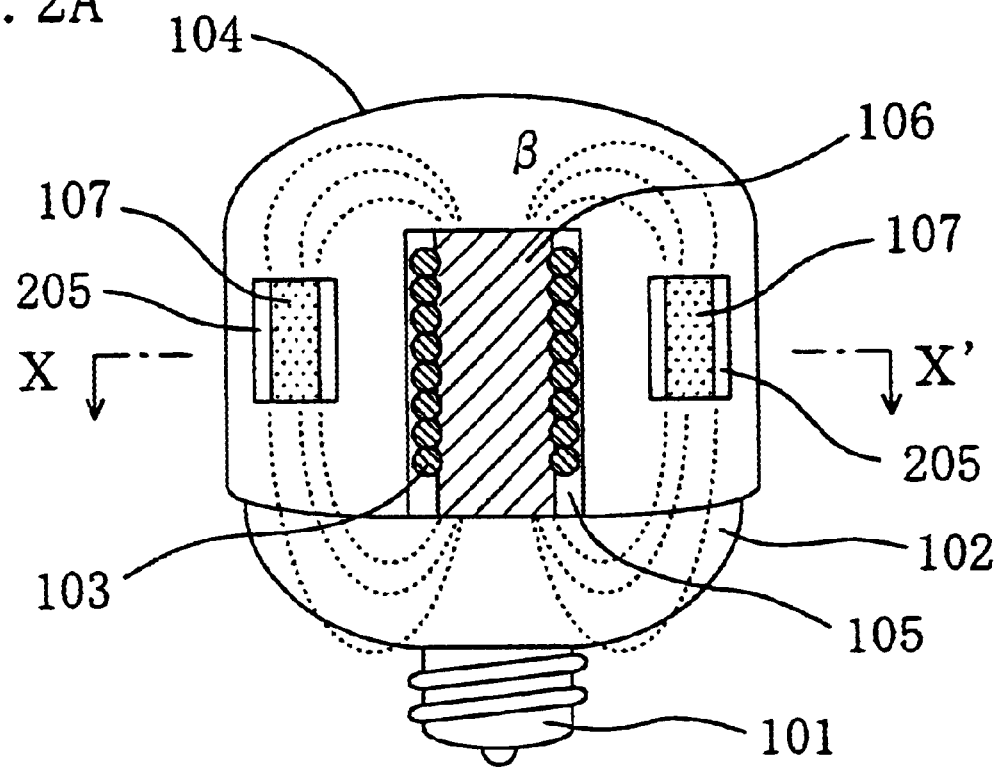
FIG. 2A is a cross-sectional view taken along the central axis of a cylindrical core showing the configuration of an electrodeless discharge lamp of Embodiment 1.
Figure 2B:
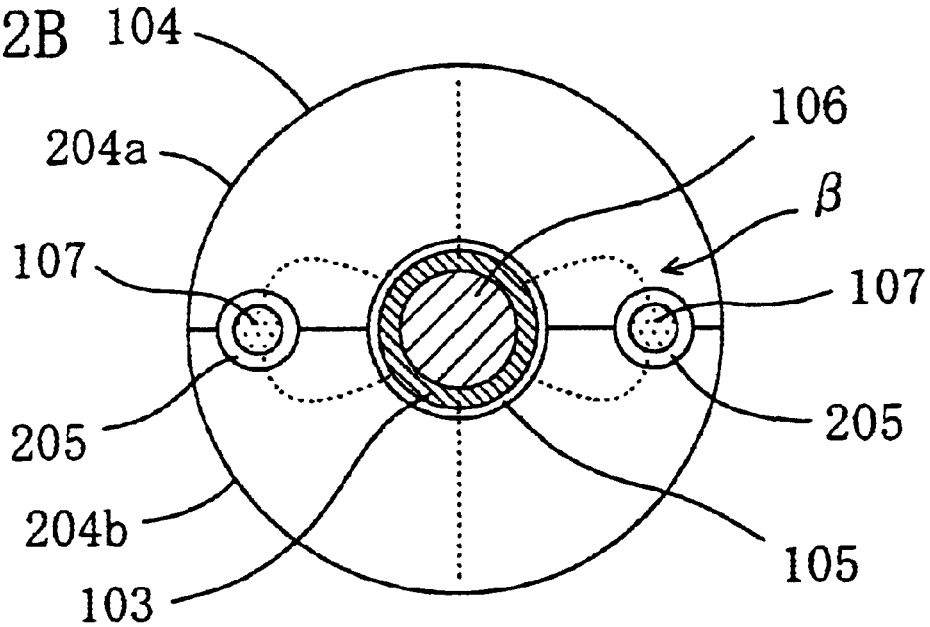
FIG. 2B is a cross-sectional view taken along a line (X–X') that is orthogonal to the central axis of the cylindrical core showing the configuration of the electrodeless discharge lamp of FIG. 2A.

In the configuration shown in FIGS. 1A and 1B, the high magnetic permeability members 107 are provided near the coil (106 and 103) with the supporting rod 108, but a configuration without the supporting rod 108 can be used. FIGS. 2A and 2B schematically show a variation of the electrodeless discharge lamp of this embodiment, and this configuration does not include the supporting rod 108.

In the electrodeless discharge lamp shown in FIGS. 2A and 2B, the high magnetic permeability members 107 are disposed in cavities 205 formed by two substantially semicircular bulbs 204*a* and 204*b*. In this configuration, an opening for coupling the discharge space between the two substantially semicircular bulbs 204*a* and 204*b* may be provided between the two bulbs 204*a* and 204*b*.

In the configuration shown in FIGS. 2A and 2B as well as in the configuration shown in FIGS. 1A and 1B, the magnetic field selectively passes through a material having a high permeability (high magnetic permeability member 107), so that as shown by the lines of magnetic force β, the magnetic field becomes dense in the vicinity of the high magnetic permeability member 107. That is to say, the magnetic field is locally intensified. As a result, the startability of the electrodeless discharge lamp can be improved.

The configuration shown in FIGS. 2A and 2B does not include the supporting rod 108 and therefore it is advantageous in that the production process of the bulb 104 is simplified, compared with the configuration shown in FIGS. 1A and 1B. In addition, when the high magnetic permeability member 107 and the supporting rod 108 are provided in the discharge space of the bulb 104, the performance may be deteriorated by ion collision of luminous gas. However, in the configuration shown in FIGS. 2A and 2B, the high magnetic permeability member 107 is disposed outside the bulb 104, and therefore such deterioration can be suppressed.

Figure 3A:
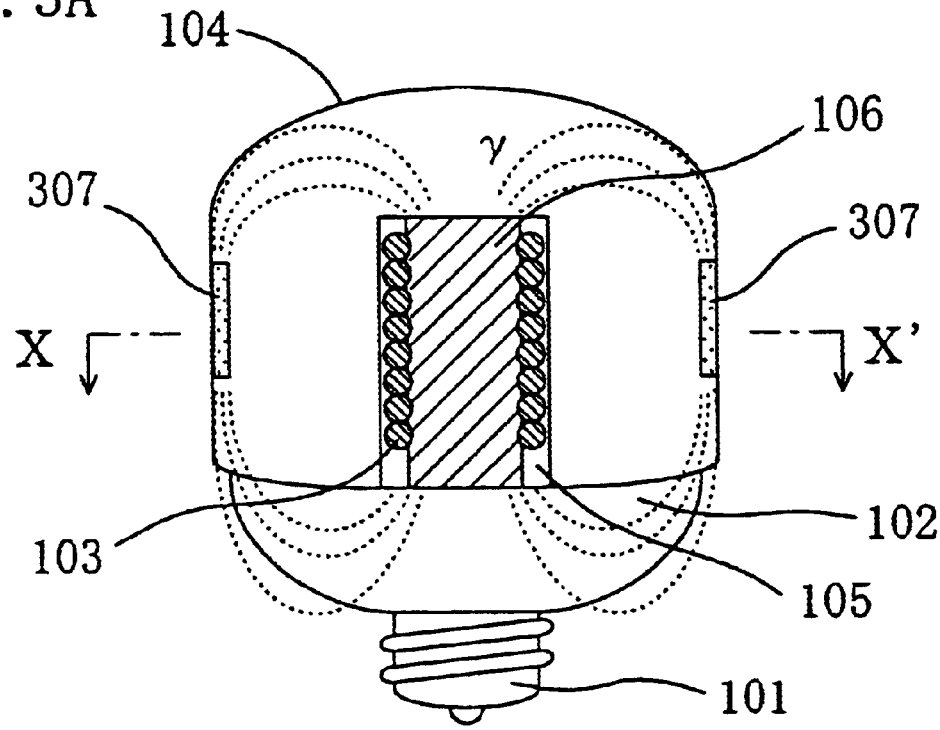
FIG. 3A is a cross-sectional view taken along the central axis of a cylindrical core showing the configuration of an electrodeless discharge lamp of Embodiment 1.
Figure 3B:
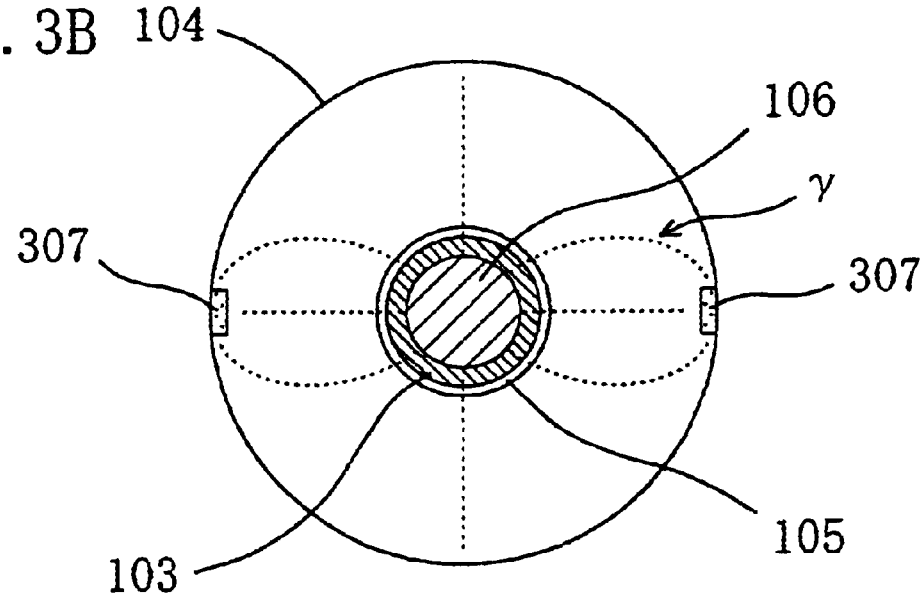
FIG. 3B is a cross-sectional view taken along a line (X–X') that is orthogonal to the central axis of the cylindrical core showing the configuration of the electrodeless discharge lamp of FIG. 3A.

In the configurations shown in FIGS. 1A, 1B, 2A and 2B, a rectangular solid or cylindrical ferrite member is used as the high magnetic permeability member 107, but as shown in FIGS. 3A and 3B, a magnetic thin film 307 made of soft ferrite can be used. The magnetic thin film 307 can be provided, for example, on the surface of the bulb 104. In the configuration shown in FIGS. 3A and 3B, the magnetic thin film 307 is formed on the inner wall of the bulb 104. However, it can be formed on the outer wall.

Also in the configuration shown in FIGS. 3A and 3B, since the magnetic field selectively passes through a material having a high permeability (magnetic thin film 307), the magnetic thin film 307 formed on the surface of the bulb 104 can restrict the spread of the magnetic field exclusively to the inside of the bulb 104, as shown by the lines of magnetic force γ. As a result, the magnetic field is locally intensified, so that the startability can be improved. In this configuration, a thin film is used as the high magnetic permeability member, and therefore this can provide a lamp having a small weight. Moreover, there is no need of providing the supporting rod 108 as in the configuration shown in FIGS. 1A and 1B In the configurations shown in FIGS. 1A and 1B to FIGS. 3A and 3B, the high magnetic permeability members 107 (or magnetic thin films 307) are left-right symmetrically provided in two portions inside or on the surface of the bulb 104. However, the present invention is not limited to this configuration. The high magnetic permeability members 107 can be formed asymmetrically or on the entire surface of the bulb 104. Alternatively, the high magnetic permeability member 107 can be provided in one portion, or three or more portions. Also in such variations, the magnetic field that is spread comparatively uniformly in the conventional configuration (see FIGS. 16A and 16B) without the high magnetic permeability member 107 can be distributed non-uniformly at the cross-section orthogonal to the central axis of the core 106 (in particular, the magnetic field can be locally intensified).

Embodiment 2

Referring to FIGS. 4A and 4B to FIGS. 9A and 9B, an electrodeless discharge lamp of Embodiment 2 of the present invention will be described.

Figure 4A:
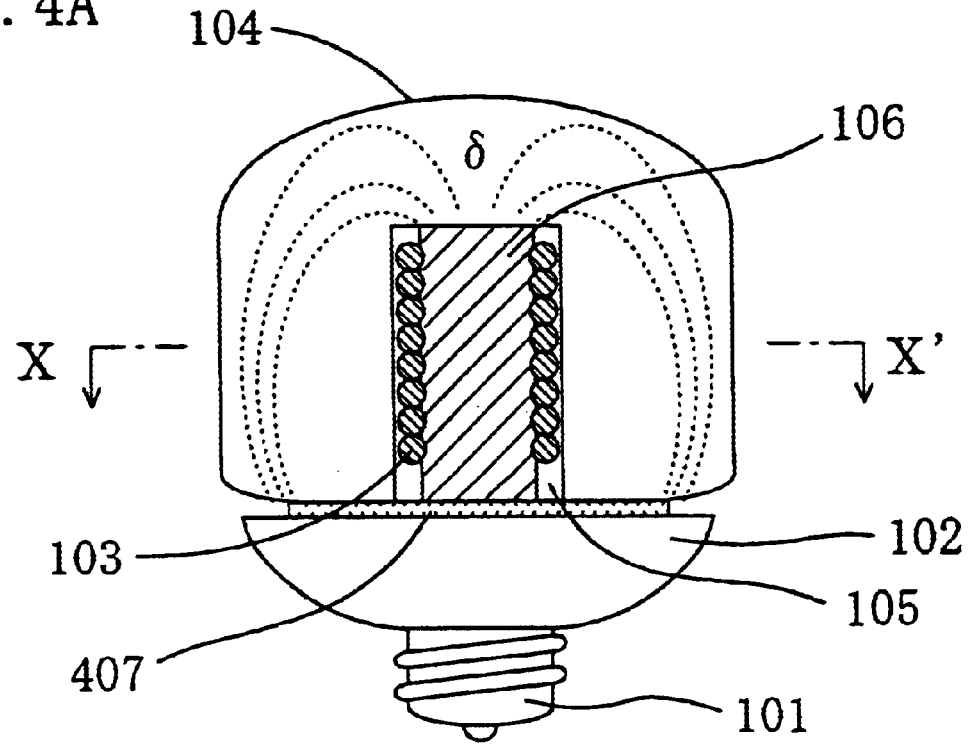
FIG. 4A is a cross-sectional view taken along the central axis of a cylindrical core showing the configuration of an electrodeless discharge lamp of Embodiment 2.
Figure 4B:
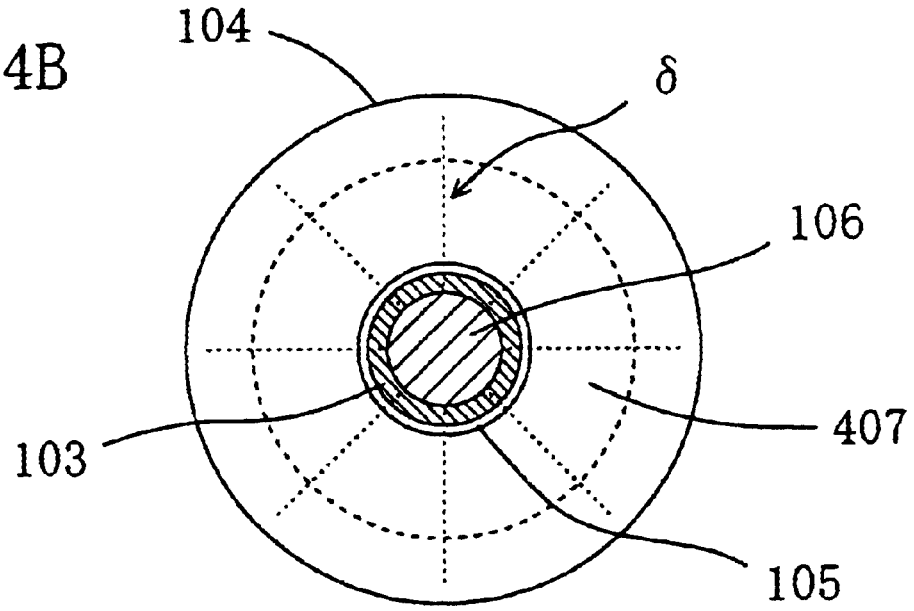
FIG. 4B is a cross-sectional view taken along a line (X–X') that is orthogonal to the central axis of the cylindrical core showing the configuration of the electrodeless discharge lamp of FIG. 4A.

First, FIGS. 4A and 4B are referred to. FIGS. 4A and 4B schematically show the configuration of the electrodeless discharge lamp of this embodiment. FIG. 4A is a cross-sectional view including the central axis of the core 106, and FIG. 4B is a cross-sectional view taken along a line X–X' in the FIG. 4A. As in FIG. 1A, in FIG. 4A and other drawings showing the similar configuration, for clarification of the drawing, the vicinity of the central axis of the core 106 and the lines of magnetic force (dotted lines) are shown in cross section, and the lamp base 101, the power source portion 102, the bulb 104 are shown in their outlook.

The electrodeless discharge lamp of this embodiment is different from that of Embodiment 1 in that a plate-shaped high magnetic permeability member 407 is inserted between the power source portion 102 and the bulb 104. Other aspects are basically the same as those in the configuration of Embodiment 1. For simplification of description of this embodiment and the following embodiments, different aspects from in Embodiment 1 will be mainly described and the description of the same aspects as in Embodiment 1 will be omitted or simplified in the following.

In the configuration shown in FIGS. 4A and 4B, a circular plate-shaped high magnetic permeability member (hereinafter, referred to as circular plate-shaped magnetic material) 407 is disposed under the cylindrical core 106, and the central axis of the cylindrical core 106 and the central axis of the circular plate-shaped magnetic material 407 are on the same axis. The circular plate-shaped magnetic material 407 is made of soft ferrite, and the diameter and the thickness of the circular plate-shaped magnetic material 407 are 10 to 200 mm and 0.5 to 10 mm, respectively. The diameter and the height of the core 106 are 5 to 50 mm and 25 to 200 mm, respectively.

In the case of the electrodeless discharge lamp of this embodiment, as shown by the lines of magnetic force δ, the magnetic field radiated from the lower portion of the cylindrical core 106 passes through the inside of the circular plate-shaped magnetic material 407 and is radiated from the end of the circular plate-shaped magnetic material 407. Therefore, the spread of the magnetic field is suppressed, and the lines of magnetic force δ inside the bulb 104 become dense. As a result of the dense lines of magnetic force δ, the magnetic field is locally intensified, and thus the startability of the lamp can be improved.

As a result of examination of the startability of the electrodeless discharge lamp with the configuration shown in FIGS. 4A and 4B by the experiments conducted by the inventors of the present invention, it was found that the time required for a lamp to turn on at an ambient temperature of 0° C. is reduced to 50% or less, compared with a lamp by the conventional technique. The following is the details of the experiments.

In the conventional configuration, a bulb, a coil core and a power source (ballast) of the electrodeless discharge lamp were allowed to stand in a thermostatic chamber at 0° C. for 12 hours, and then the lamp was started at 90 V in a low temperature and dark place. It took 13 or 15 seconds for the lamp to turn on. On the other hand, in the configuration shown in FIGS. 4A and 4B, a bulb (104), a coil (106 and 103) and a power source 102 (ballast) of the electrodeless discharge lamp were allowed to stand in a thermostatic chamber at 0° C. for 24 hours, and then the lamp was started at 90 V in a low temperature and dark place. It took 8 or 4 seconds for the lamp to turn on. Thus, it was confirmed that the startability could be improved significantly. The conditions of the electrodeless discharge lamp used in the experiments were as follows: the inner volume of the bulb 104 was 170 $cm^3$, and the amount of mercury enclosed was 4 mg, and the pressure of argon enclosed was 240 Pa. The coil (106 and 103) had a diameter of 14 mm and a length of 55 mm, the winding 103 was wounded around the core 106 in 66 winds, the frequency of the alternating current supplied by the power source 102 was 85 kHz.

In the configuration of this embodiment, unlike the configuration shown in FIGS. 1A and 1B, a high magnetic permeability member is not disposed inside the bulb 104, so that the luminous flux emitted outside can be increased, compared with the configuration shown in FIGS. 1A and 1B. As a result, another advantage is that the lamp efficiency advantageously can be increased.

Figure 5A:
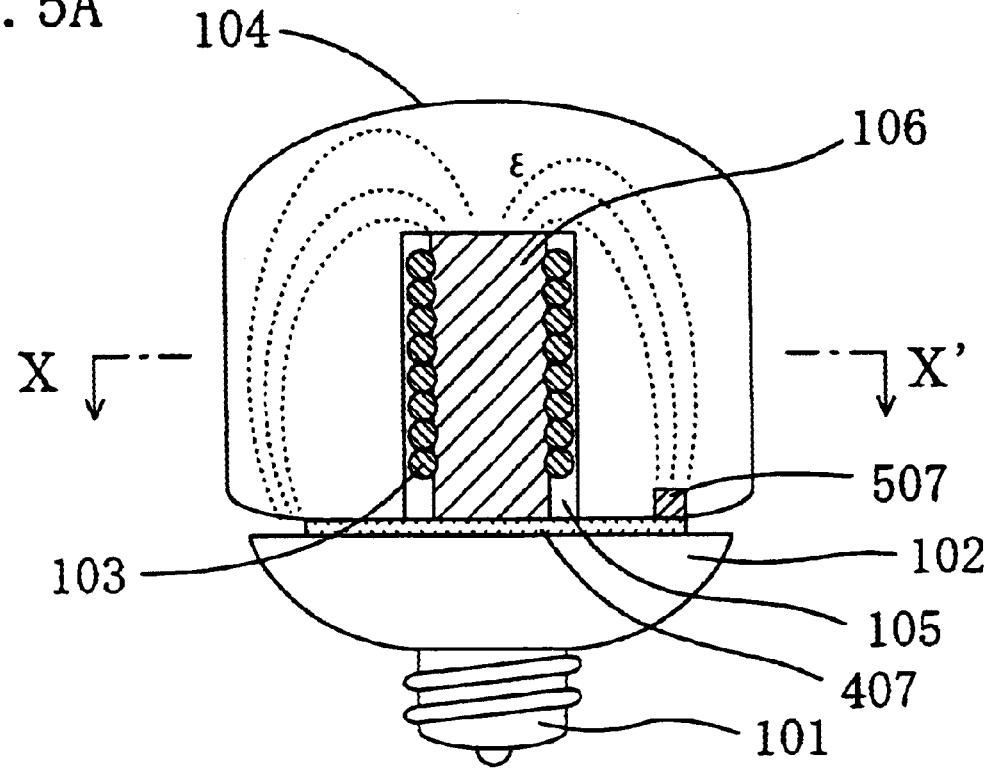
FIG. 5A is a cross-sectional view taken along the central axis of a cylindrical core showing the configuration of an electrodeless discharge lamp of Embodiment 2.
Figure 5B:
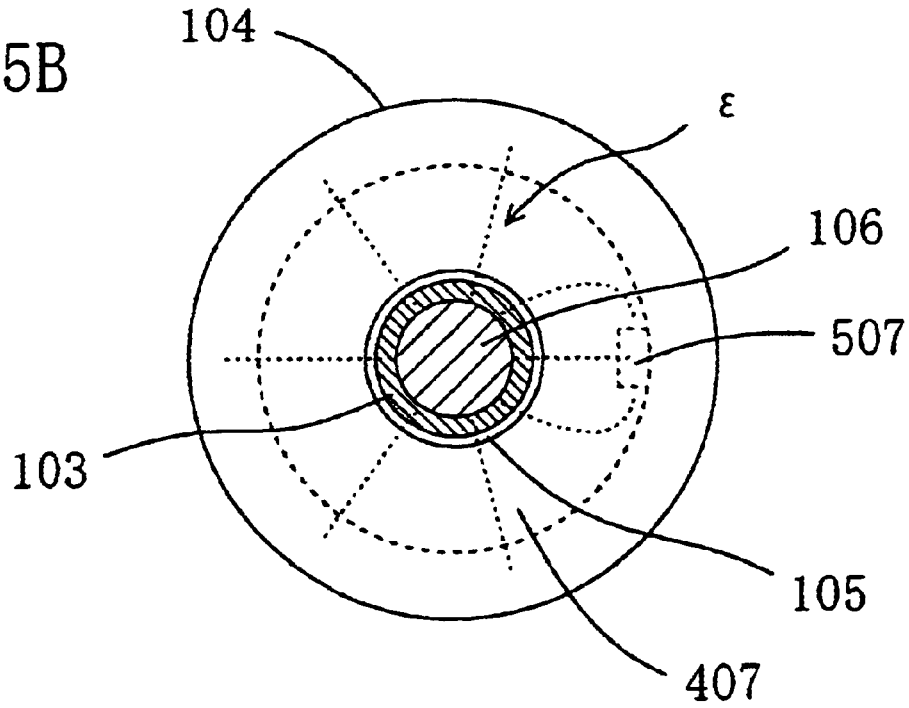
FIG. 5B is a cross-sectional view taken along a line (X–X') that is orthogonal to the central axis of the cylindrical core showing the configuration of the electrodeless discharge lamp of FIG. 5A.
Figure 6A:
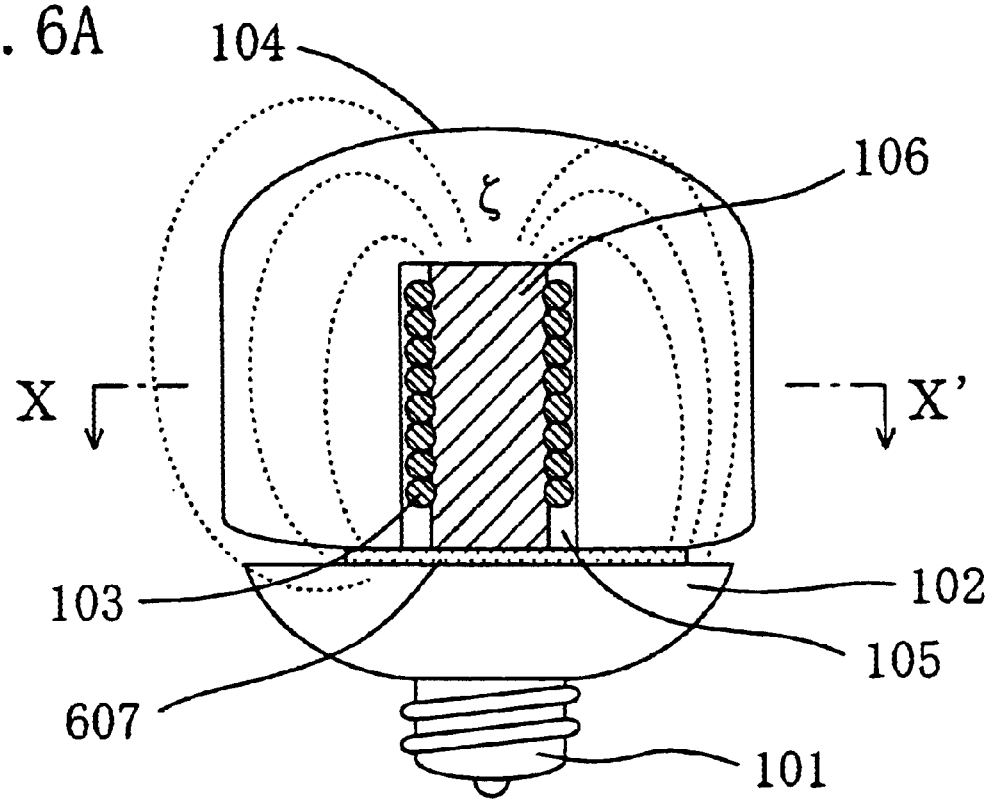
FIG. 6A is a cross-sectional view taken along the central axis of a cylindrical core showing the configuration of an electrodeless discharge lamp of Embodiment 2.
Figure 6B:
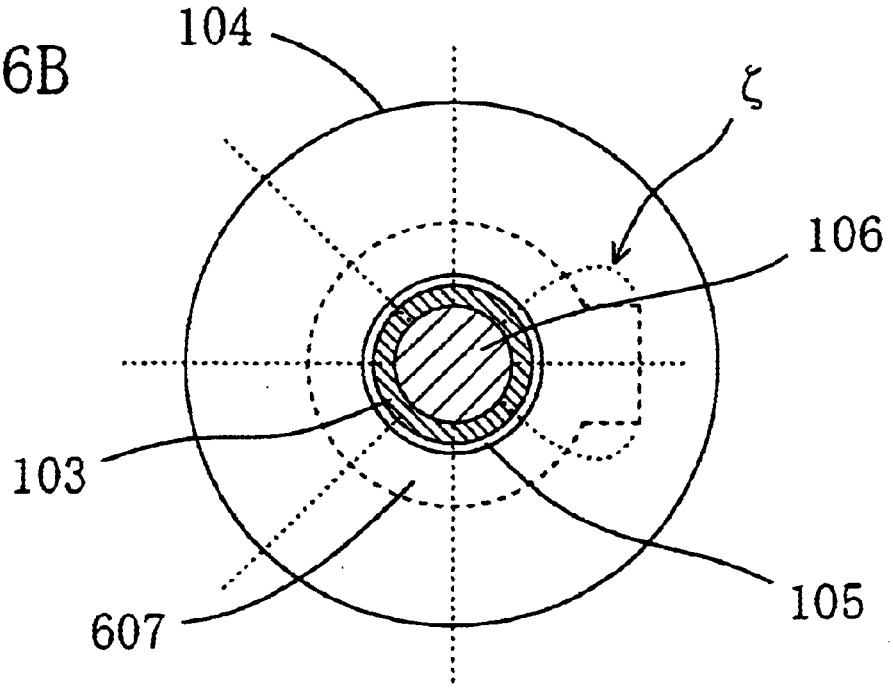
FIG. 6B is a cross-sectional view taken along a line (X–X') that is orthogonal to the central axis of the cylindrical core showing the configuration of the electrodeless discharge lamp of FIG. 6A.
Figure 7A:
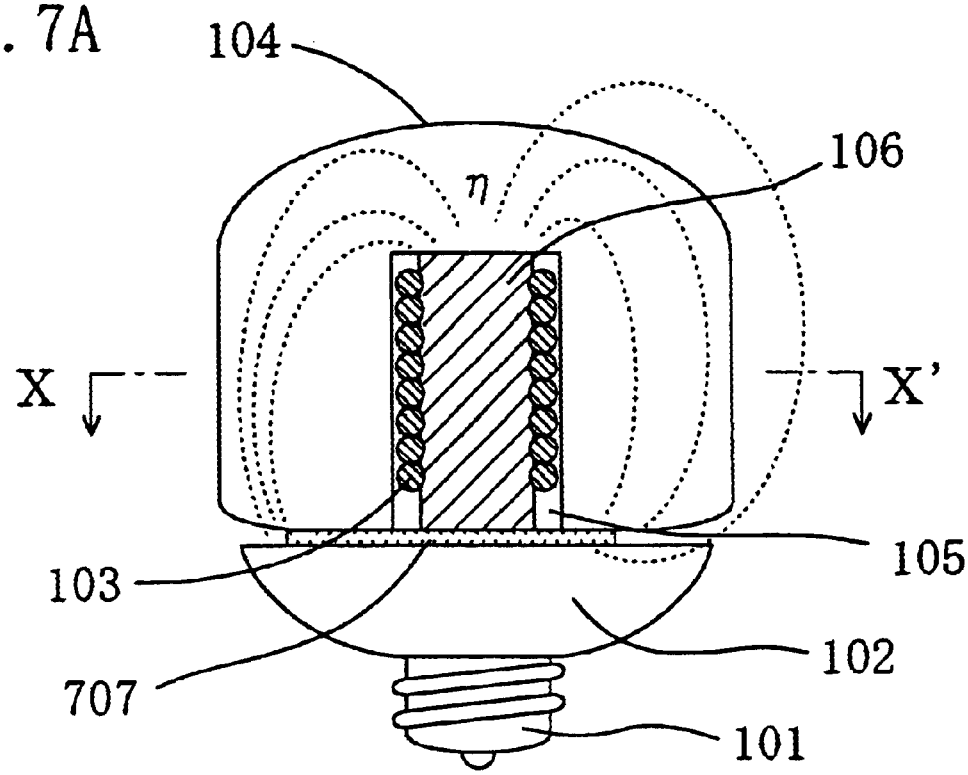
FIG. 7A is a cross-sectional view taken along the central axis of a cylindrical core showing the configuration of an electrodeless discharge lamp of Embodiment 2.
Figure 7B:
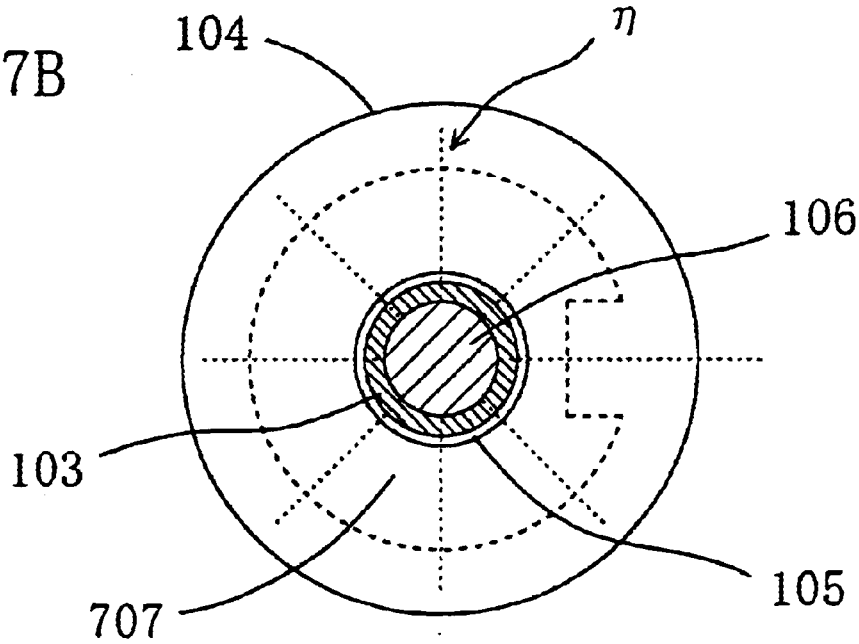
FIG. 7B is a cross-sectional view taken along a line (X–X') that is orthogonal to the central axis of the cylindrical core showing the configuration of the electrodeless discharge lamp of FIG. 7A.

The configuration shown in FIGS. 4A and 4B can be modified to one shown in FIGS. 5A and 5B. In the configuration shown in FIGS. 5A and 5B, a protrusion 507 is provided on the surface of the circular plate-shaped magnetic material 407. In the configuration shown in FIGS. 5A and 5B, the magnetic field passes through the inside of the protrusion 507, and therefore the magnetic field can be concentrated in a part of the bulb 104, as shown by the lines of magnetic force $\epsilon$ As a result, the startability can be improved further.

The shape of the primary plane of the circular plate-shaped magnetic material 407 is circular. However, the present invention is not limited thereto, and plate-shaped magnetic materials having a shape of ellipse, triangle, rectangle, pentagon, or hexagon can be used. Furthermore, a plate-shaped magnetic material that is not symmetric with respect to the central axis of the core 106, that is, a plate-shaped magnetic material having an asymmetric shape can be used.

FIGS. 6A, 6B, 7A and 7B show electrodeless discharge lamps in which asymmetric plate-shaped magnetic materials (607 and 707, respectively) are disposed under the cylindrical cores 106. Both the plate-shaped magnetic materials 607 and 707 have a shape without the central point that can bisect the shape so that the distance to the end is constant. In the plate-shaped magnetic materials 607 shown in FIGS. 6A and 6B, a protrusion is provided at one side on the outer circumference of the circular shape. In the plate-shaped magnetic materials 707 shown in FIGS. 7A and 7B, a recess (or a notch) is provided at one side on the outer circumference of the circular shape.

In the configurations shown in FIGS. 6A, 6B, 7A and 7B, the magnetic field radiated from the lower portion of the cylindrical core 106 passes through the inside of the plate-shaped magnetic materials 607 and 707 is radiated from the end of the plate-shaped magnetic materials 607 and 707. Therefore, as shown by the lines of magnetic force $\xi$ and $\eta$, the magnetic field is distributed non-uniformly at the cross-section orthogonal to the central axis of the cylindrical core 106. In other words, the magnetic field is intensified locally in some portions. Then, the magnetic field is concentrated inside or in a part of the bulb 104, and therefore the startability can be improved.

Also in the case where the cross-section taken along a line X–X' of the bulb 104 is a shape other than a circle, the startability can be improved by changing the shapes of the plate-shaped magnetic materials 607 and 707 in accordance with the cross-sectional shape of the bulb 104.

Figure 8A:
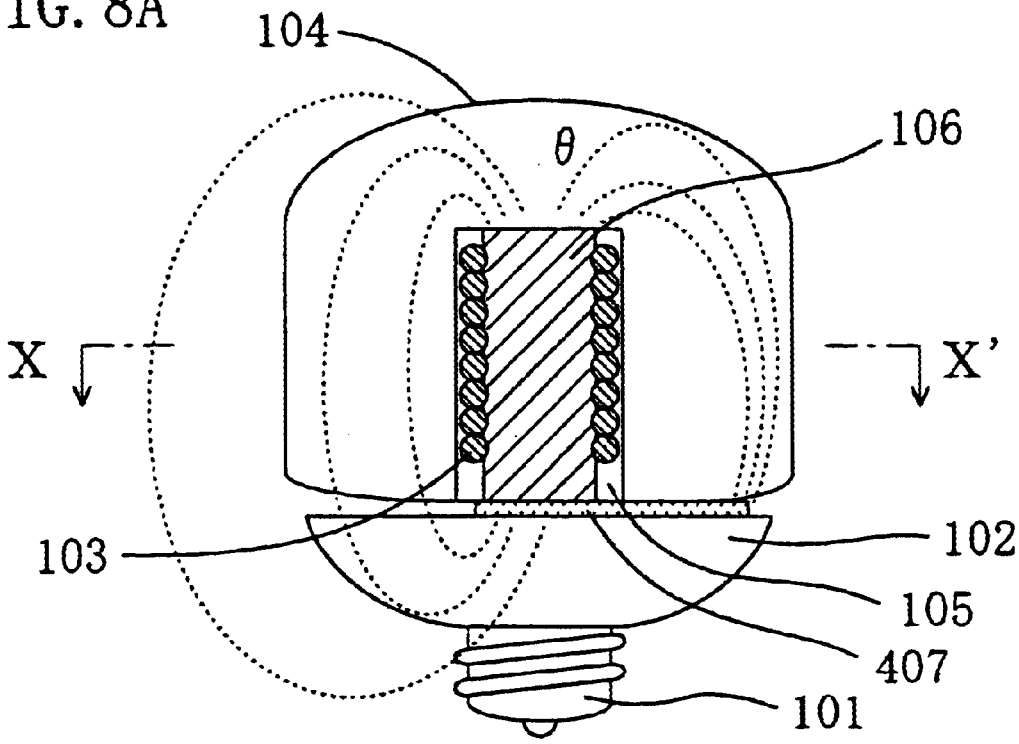
FIG. 8A is a cross-sectional view taken along the central axis of a cylindrical core showing the configuration of an electrodeless discharge lamp of Embodiment 2.
Figure 8B:
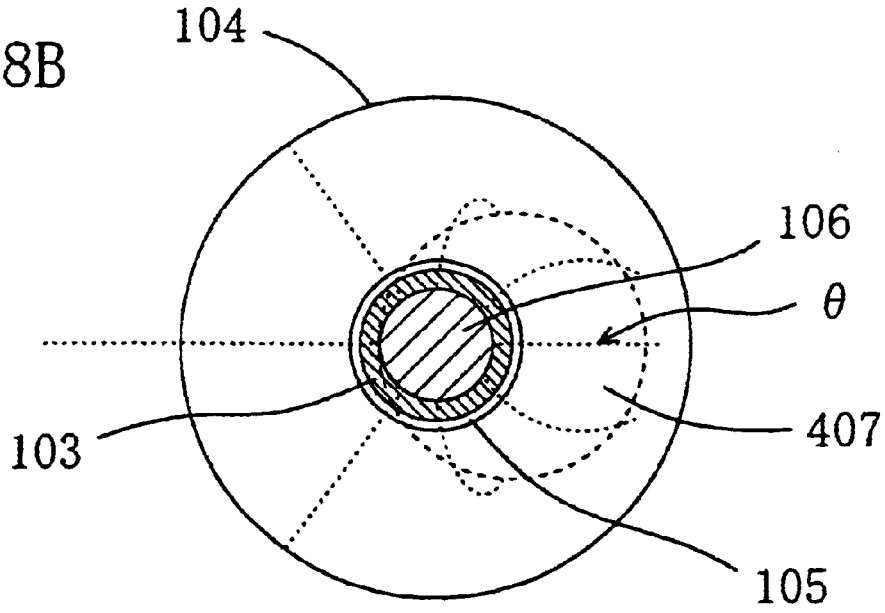
FIG. 8B is a cross-sectional view taken along a line (X–X') that is orthogonal to the central axis of the cylindrical core showing the configuration of the electrodeless discharge lamp of FIG. 8A.

In the case where the circular plate-shaped magnetic material 407 is used, as shown in FIGS. 8A and 8B, the circular plate-shaped magnetic material 407 can be disposed under the cylindrical core 106 in such a manner that the center of the circle is not on the same axis as the central axis of the cylindrical core 106. In this case, the magnetic field released from the cylindrical core 106 passes through the inside of the circular plate-shaped magnetic material 407, so that the magnetic field becomes dense only in the direction in which the circular plate-shaped magnetic material 407 is located, as shown in the lines of magnetic force $\theta$. As a result, the startability can be improved. In this configuration, a smaller material than the circular plate-shaped magnetic material 407 shown in FIGS. 4A and 4B can be used, so that this is advantageous in that the weight of the apparatus and the cost can be reduced.

Figure 9A:
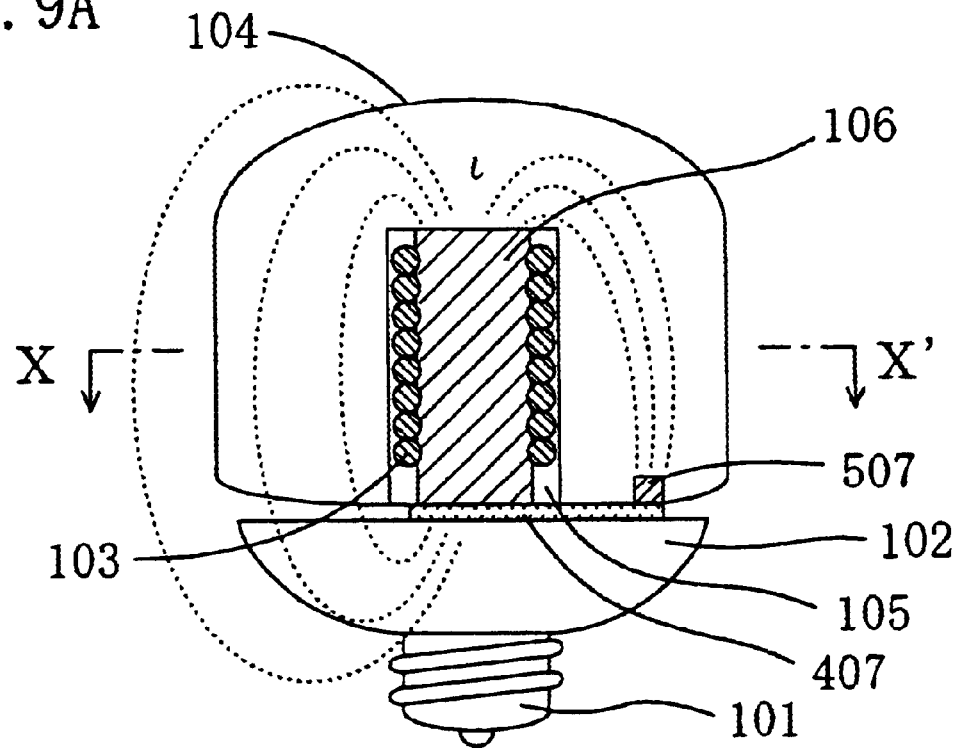
FIG. 9A is a cross-sectional view taken along the central axis of a cylindrical core showing the configuration of an electrodeless discharge lamp of Embodiment 2.
Figure 9B:
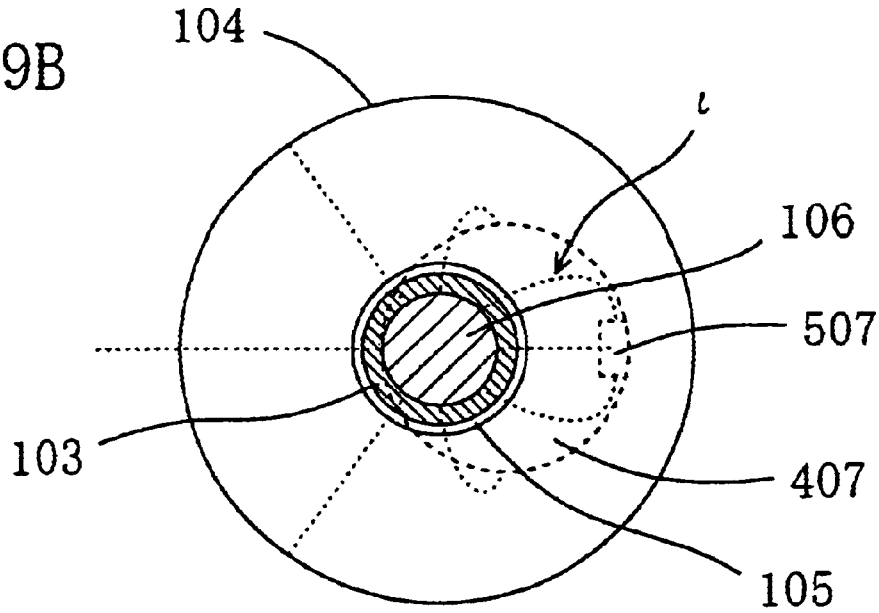
FIG. 9B is a cross-sectional view taken along a line (X–X') that is orthogonal to the central axis of the cylindrical core showing the configuration of the electrodeless discharge lamp of FIG. 9A.

Furthermore, as shown in FIGS. 9A and 9B, a protrusion 507 can be provided on the surface of the circular plate-shaped magnetic material 407 shown in FIGS. 8A and 8B. In this configuration, the magnetic field passes through the inside of the protrusion 507 so that the magnetic field becomes dense in a part of the bulb 104, as shown by the lines of magnetic force $\delta$. As a result, the startability of the lamp was improved significantly.

In this embodiment, the protrusion 507 is provided on the surface of the circular plate-shaped magnetic material 407, but it can be provided on the cylindrical core 106. Furthermore, the protrusion 507 provided in the circular plate-shaped magnetic material 407 is a quadratic prism. However, the present invention is not limited thereto, and for example a cylinder, a cone, a truncated cone, a polygonal prism, a polygonal pyramid, a truncated polygonal pyramid, a semi-sphere or the like can be used. Regarding the number, not only one, but also a plurality of protrusions can be provided.

Embodiment 3

Figure 10A:
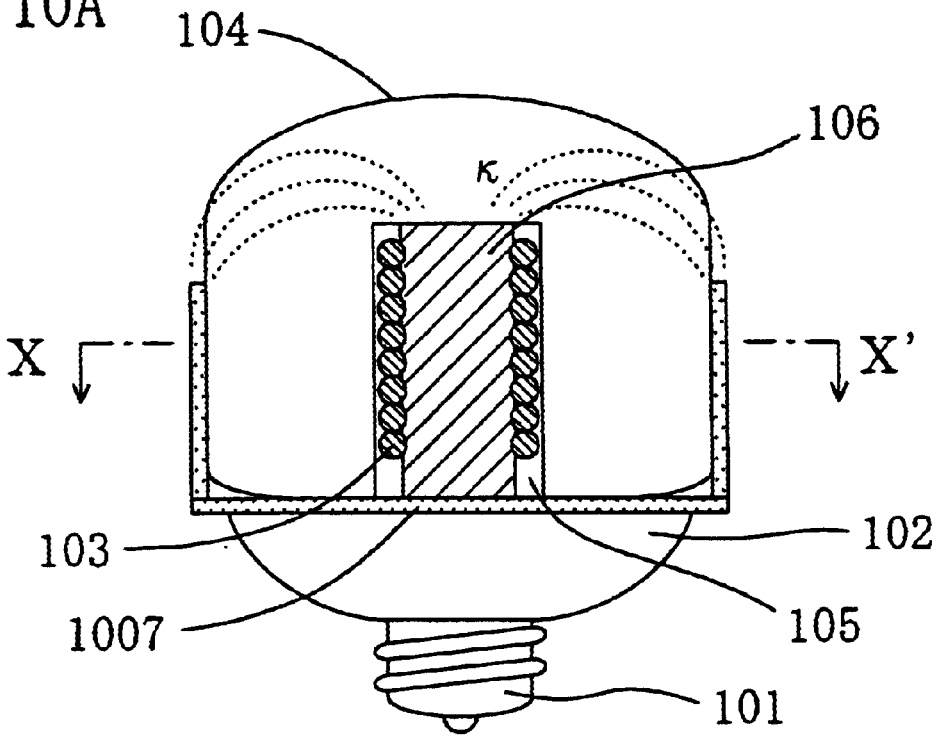
FIG. 10A is a cross-sectional view taken along the central axis of a cylindrical core showing the configuration of an electrodeless discharge lamp of Embodiment 3.
Figure 10B:
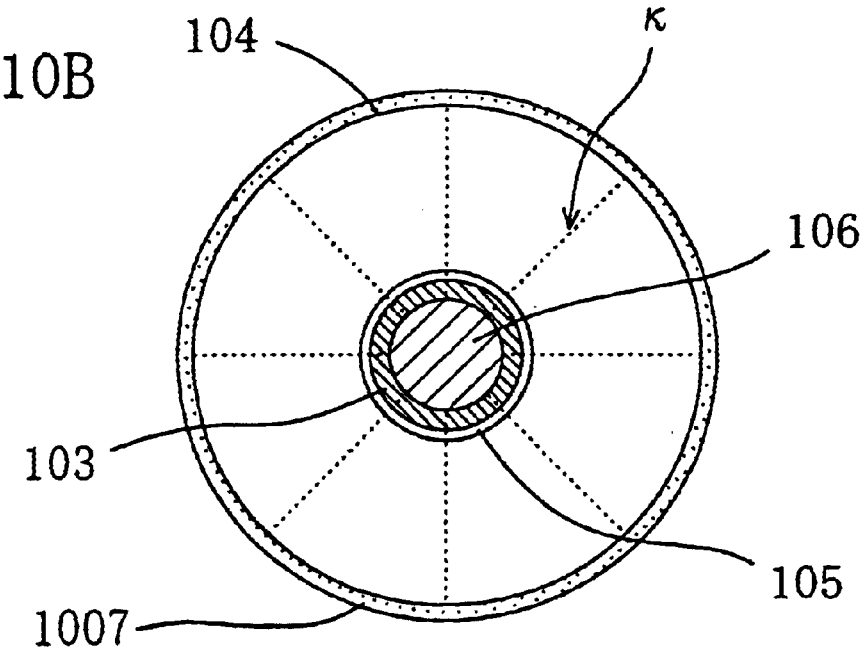
FIG. 10B is a cross-sectional view taken along a line (X–X') that is orthogonal to the central axis of the cylindrical core showing the configuration of the electrodeless discharge lamp of FIG. 10A.

Referring to 10A and 10B, an electrodeless discharge lamp of Embodiment 3 of the present invention will be described. FIGS. 10A and 10B schematically show the configuration of the electrodeless discharge lamp of this embodiment. FIG. 10A is a cross-sectional view including the central axis of the core 106, and FIG. 10B is a cross-sectional view taken along a line X–X' in the FIG. 10A.

The electrodeless discharge lamp of this embodiment is different from that of Embodiment 2 including the plate-shaped high magnetic permeability member 407 in that it includes a high magnetic permeability member 1007 surrounding the bottom and the lower portion of the side faces of the bulb 104 positioned on the side of the power source portion 102. Other aspects are basically the same as those in the configuration of Embodiment 2. For simplification, the description of the same aspects as in Embodiment 2 will be omitted or simplified.

The high magnetic permeability member 1007 in this embodiment has a U-shaped cross-sectional shape. In the configuration shown in FIGs. 10A and 10B, the high magnetic permeability member 1007 has a cylindrical shape provided with a bottom. In other words, the high magnetic permeability member 1007 is a bottom-provided cylindrical magnetic material. The cross-section of the bottom-provided cylindrical magnetic material 1007 is also said to be a recessed shape. In this configuration, the cylindrical core 106 is disposed on the central axis of the bottom of the circular plate.

In the configuration shown in FIGS. 10A and 10B, the magnetic field radiated from the lower portion of the cylindrical core 106 passes through the inside of the bottom-provided cylindrical magnetic material 1007, and therefore the magnetic field shown by the lines of magnetic force κ is formed. In this embodiment, almost all magnetic flux can be converged within the bulb 104, and therefore the startability can be improved significantly.

Embodiment 4

Figure 11:
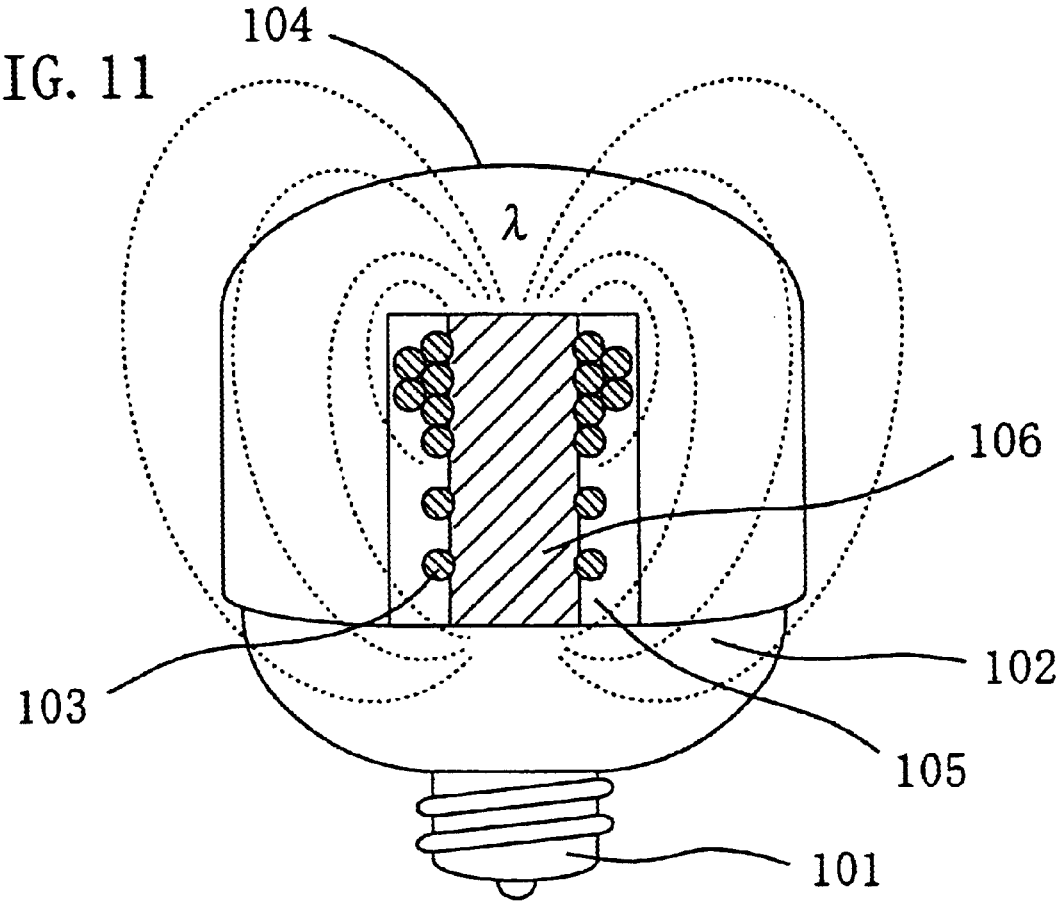
FIG. 11 is a cross-sectional view taken along the central axis of a cylindrical core showing the configuration of an electrodeless discharge lamp of Embodiment 4.

Referring to FIG. 11, an electrodeless discharge lamp of Embodiment 4 of the present invention will be described. FIG. 11 schematically shows the configuration of the electrodeless discharge lamp of this embodiment and is a cross-section view including the central axis of the core 106.

In the electrodeless discharge lamp of this embodiment, the coil constitutes means for improving the startability is constituted by a coil having the following configuration. The winding density of the winding 103 wound around the core 106 is sparse on the side of the power source 102 and is dense on the side opposite to the power source 102 (upper side or on the side of the bulb 104). This configuration is basically the same as that shown in FIGS. 16A and 16B except that the winding 103 is wound such that the winding density of the winding 103 is sparse on the side of the power source portion 102 and is dense on the side opposite to the power source portion 102.

It is known that when current flows through a wire that forms a circle, the magnetic field passing through the cross-section area surrounded by the winding is proportional to the number of windings, and is inversely proportional to the cross-section area. Therefore, in this embodiment, the magnetic field becomes dense in the bulb 104 on the side opposite to the power source portion, as shown by the lines of magnetic force λ in FIG. 11. As a result, an intense induction field is generated in that portion where the magnetic field is dense, and argon gas and mercury are excited easily, and thus the startability is improved.

Embodiment 5

Figure 12:
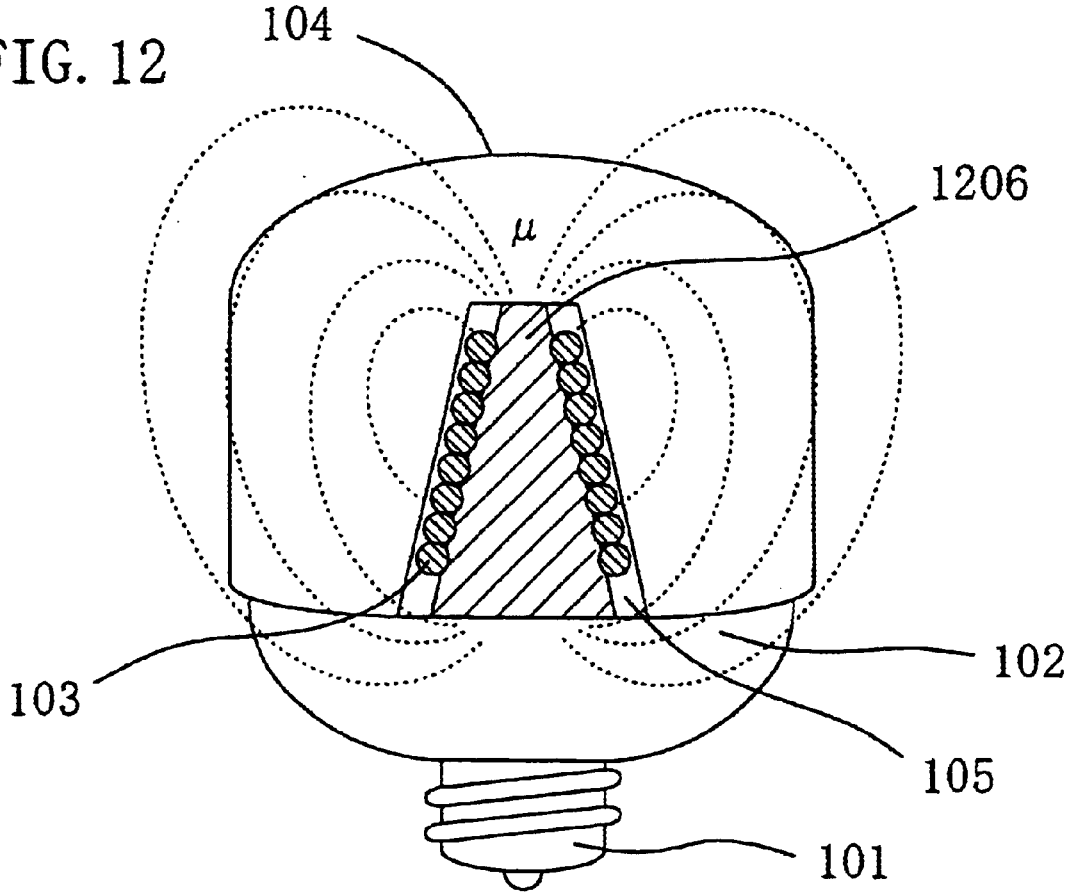
FIG. 12 is a cross-sectional view taken along the central axis of a core showing the configuration of an electrodeless discharge lamp of Embodiment 5.

Referring to FIG. 12, an electrodeless discharge lamp of Embodiment 5 of the present invention will be described. FIG. 12 schematically shows the configuration of the electrodeless discharge lamp of this embodiment and is a cross-section view including the central axis of the core 1206.

The electrodeless discharge lamp of this embodiment is different from Embodiment 4 in that a truncated conical core 1206 in which the cross-section area of the core is varied along the central axis of the core is used to constitute means for improving the startability. More specifically, the core 1206 has different cross-section areas from cross-section to cross-section orthogonal to its central axis, and the startability improving means is constituted by a coil including the core 1206.

The magnetic field passing through the cross-section surrounded by the winding is inversely proportional to the cross-section, so that in this embodiment as well as in Embodiment 4, the magnetic field is dense inside the bulb 104 on the side opposite to the power source portion 102 (upper portion), as shown by the lines of magnetic force $\mu$. As a result, the startability is improved.

The configurations of Embodiments 4 and 5, the startability of the lamp is improved simply by changing the winding density of the winding or changing the shape of the core. Therefore, there is no need of increasing the number of components, nor need of changing in the lamp production process. Furthermore, compared with Embodiments 1 and 3, the efficiency of emission of light to the outside of the bulb 104 is better, because the magnetic materials are not provided in the direction to which light is emitted from the lamp.

Embodiment 6

Figure 13A:
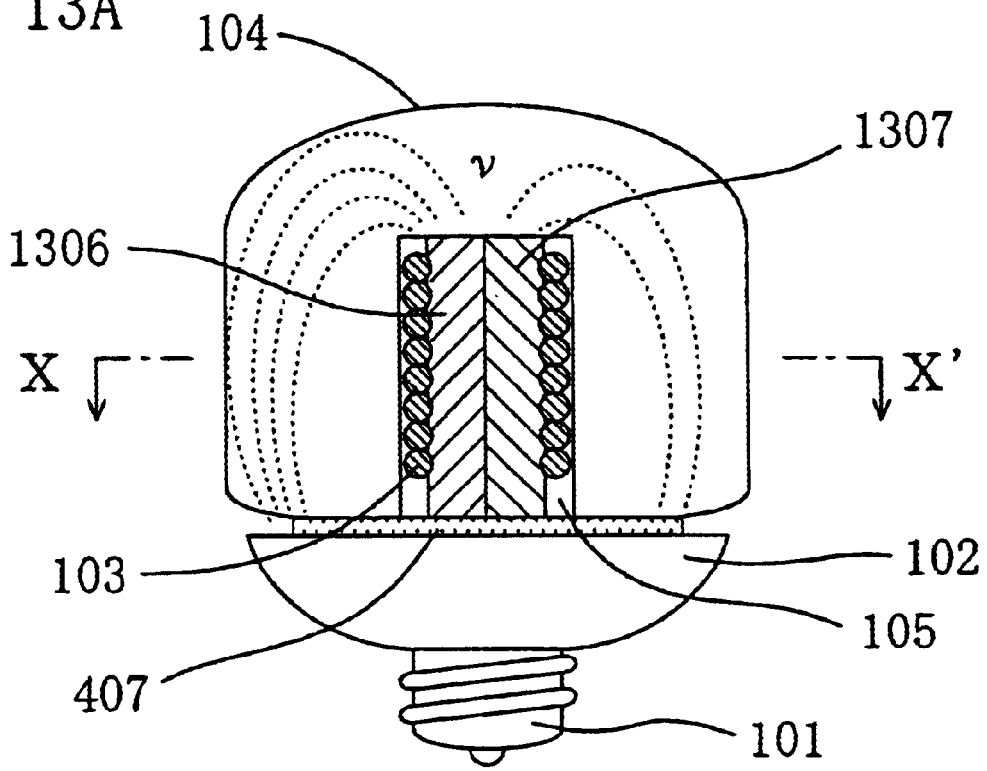
FIG. 13A is a cross-sectional view taken along the central axis of a core showing the configuration of an electrodeless discharge lamp of Embodiment 6.
Figure 13B:
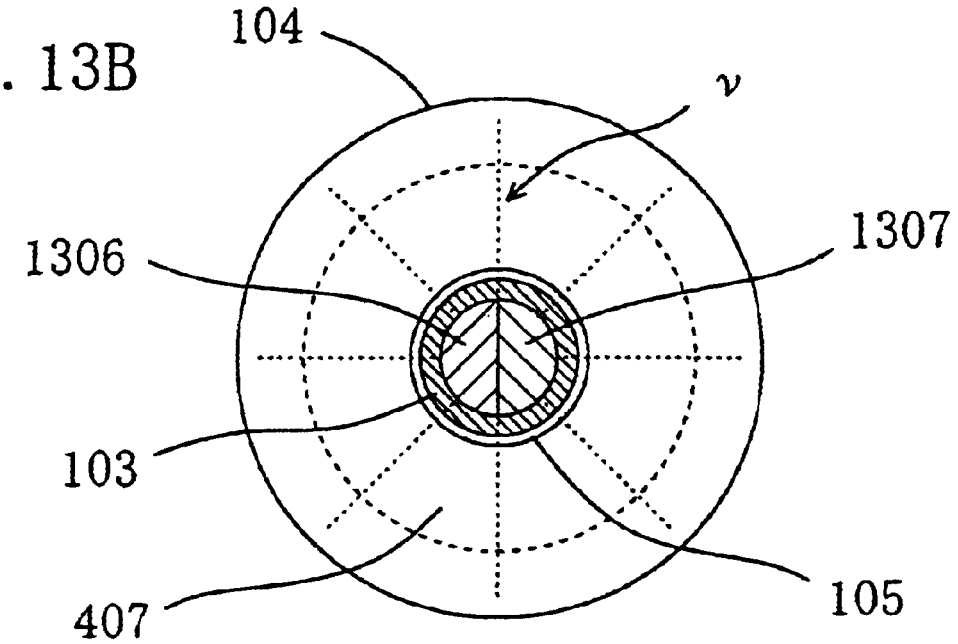
FIG. 13B is a cross-sectional view taken along a line (X–X') that is orthogonal to the central axis of the cylindrical core showing the configuration of the electrodeless discharge lamp of FIG. 13A.

Referring to FIGS. 13A and 13B, an electrodeless discharge lamp of Embodiment 6 of the present invention will be described. FIGS. 13A and 13B schematically show the configuration of the electrodeless discharge lamp of this embodiment. FIG. 13A is a cross-sectional view including the central axis of the core, and FIG. 13B is a cross-sectional view taken along a line X–X' in the FIG. 13A.

In the electrodeless discharge lamp of this embodiment, the startability improving means is constituted by a coil provided with a core made of two or more magnetic materials having different magnetic permeabilities (or magnetic susceptibilities). The core shown in FIGS. 13A and 13B includes a semi-cylindrical cores 1306 and 1307, and the relationship between the magnetic permeability $\mu$A of the semi-cylindrical cores 1306 and the magnetic permeability $\mu$B. of the semi-cylindrical cores 1307 satisfies $\mu A > \mu B$. The cylindrical core including the cores 1306 and 1307 is inserted in the cavity 105.

In the configuration shown in FIGS. 13A and 13B, if the cross-section area and the number of winding are the same between the semi-cylindrical cores 1306 and 1307, the magnetic field occurs more intensely in the vicinity of the magnetic material having a larger magnetic permeability. Therefore, as shown by the lines of magnetic force ν, the magnetic field is dense in the vicinity of the semi-cylindrical cores 1306 in the bulb 104. Thus, the startability is improved.

Figure 14:
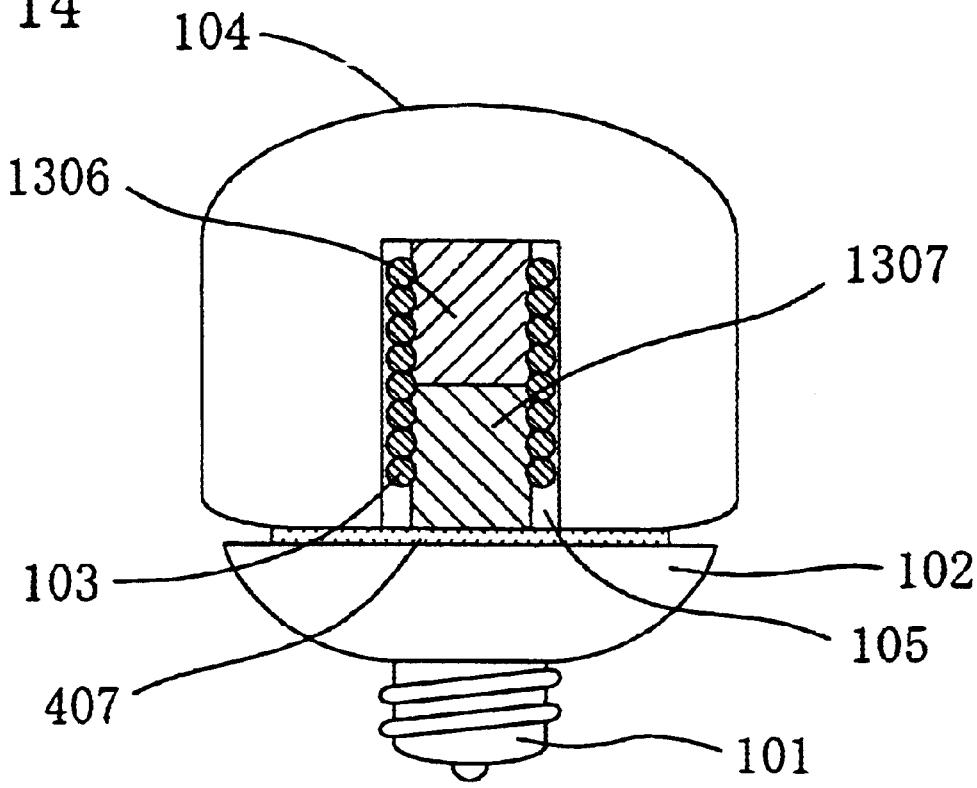
FIG. 14 is a cross-sectional view taken along the central axis of a core showing the configuration of an electrodeless discharge lamp of Embodiment 6.

Also in the configuration as shown in FIG. 14 in which two or more magnetic materials having different magnetic permeabilities (1306 and 1307) are layered in the vertical direction, the magnetic field occurs more intensely in the vicinity of the magnetic material having a larger magnetic permeability. Therefore, the startability is improved. In FIG. 14, dotted lines indicating the lines of magnetic force are omitted.

In Embodiments 1 to 4, the cylindrical core 106 is used as the core, and in Embodiment 5, the truncated conical core 1206 is used. In Embodiment 6, the semi-cylindrical cores 1306 and 1307 (cylindrical cores 1306 and 1307) are used. These cores are solid inside, but can be hollow. That is to say, the core can have a through-hole inside. Alternatively, the shape of the core can be any one of a cylinder, a cone, a truncated cone, a polygonal prism, a polygonal pyramid, a truncated polygonal pyramid, and a semi-sphere In Embodiments 1 to 6, only one core is used, but the number of the core is not limited to one, and a plurality of cores can be disposed. Furthermore, in Embodiments 1 to 6, one or two high magnetic permeability members (magnetic materials) are disposed near the coil. However, the number of the high magnetic permeability members (magnetic materials) can be determined suitably for the desired characteristics. Therefore, three or more can be used. The shape of the high magnetic permeability member (magnetic material) also can be any one of a cylinder, a cone, a truncated cone, a polygonal prism, a polygonal pyramid, a truncated polygonal pyramid, and a semi-sphere Moreover, in Embodiments 1 to 6, argon and mercury as luminous gases are enclosed, but the present invention is not limited thereto. As rare gas, xenon, argon, krypton, neon and helium and mixture thereof can be used. As luminous gas, it is also possible to use substantially mercury alone, or a rare gas alone substantially without mercury. It is also possible to add a metal halide to the constitution of luminous gas. That is to say, specific discharge gases are not excluded.

In Embodiments 1 to 6, a core made of Mn—Zn based ferrite is used, but cores made of other materials can be used.

The material of the high magnetic permeability member (magnetic material) is not limited to those described above. In Embodiments 1 to 6, a phosphor is applied onto the bulb 104, but an effect of improving the startability can be obtained without a phosphor.

Figure 15A:
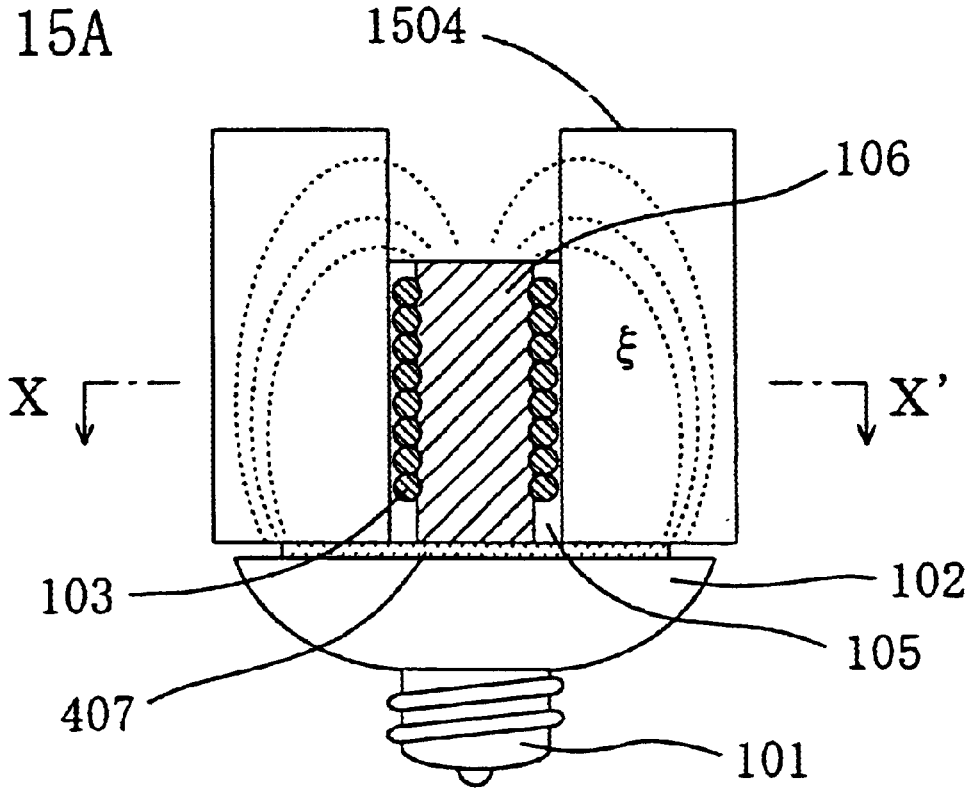
FIG. 15A is a cross-sectional view taken along the central axis of a cylindrical core showing the configuration of an electrodeless discharge lamp using a cylindrical bulb.
Figure 15B:
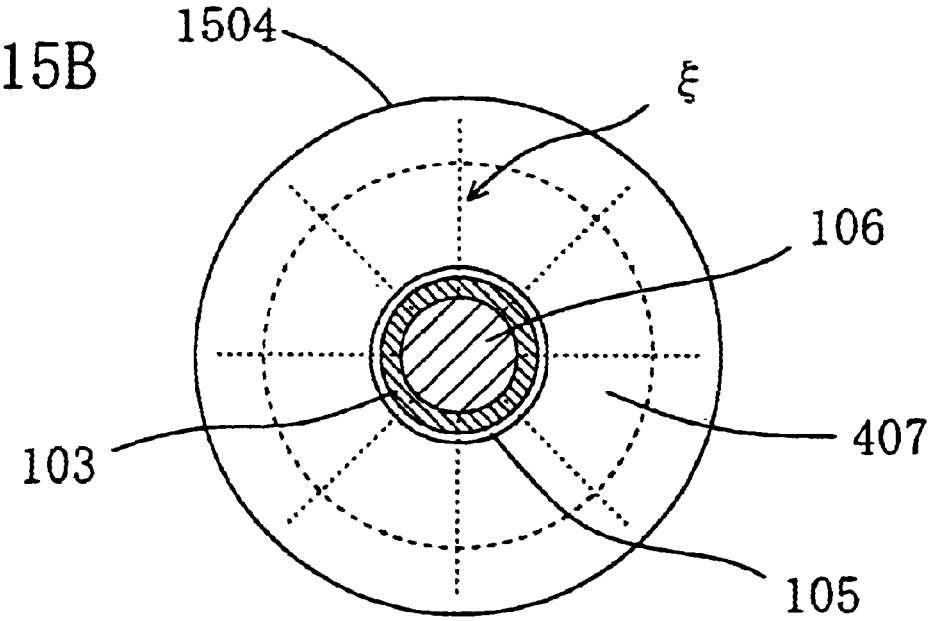
FIG. 15B is a cross-sectional view taken along a line (X–X') that is orthogonal to the central axis of the cylindrical core showing the configuration of the electrodeless discharge lamp of FIG. 15A.

In Embodiments 1 to 6, a self-ballasted electrodeless discharge lamp in which the power source portion 102 for supplying a high frequency alternating current power to the winding is integrated to the bulb 104 and the coil has been described. However, the effect of improving the startability can be obtained even if the power source portion 102 is separated. In Embodiments 1 to 6, the bulb 104 includes the cavity 105, but the bulb can have any shape, as long as the coil can be disposed near the bulb 104. For example, a bulb 1504 having a hollow cylindrical shape as shown in FIGS. 15A and 15B can be used. Also in the configuration shown in FIGS. 15A and 15B, from the same principle as that in Embodiment 2, the magnetic field is dense inside the bulb 104 as shown by the lines of magnetic force ξ, and as a result, the startability can be improved.

It is also possible to combine the features of Embodiments 1 to 6. For example, a protrusion (507 etc.) or a recess shown in FIGS. 5A to 7B can be provided in the member 1007 shown in FIGS. 10A,and 10B and the coil of Embodiments 4 to 6 and the high magnetic permeability member of Embodiments 1 to 3 can be combined.

As described above, according to the electrodeless discharge lamp of the embodiments of the present invention, the poor startability (in particular, startability at low temperatures) which is problematic in lamps operated based on discharge of luminous gas can be overcome by a high frequency magnetic field generated by disposing the coil including the core and the winding near the bulb and supplying a high frequency power to the coil. More specifically, a portion having a high intensity of electric field is provided in a part of the discharge space by disposing a high magnetic permeability member near the core or making the winding density sparse or dense or the like to provide a configuration having non-uniform distribution at cross-sections orthogonal to the central axis of the core, or a configuration in which the distribution of the high frequency alternating magnetic field is deviated to the direction opposite to the power source at the cross-section including the central axis of the core. As a result, the startability of the lamp can be improved.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electrodeless discharge lamp comprising:

a translucent bulb enclosing a luminous material;

a coil for generating an alternating magnetic field that causes discharge in the luminous material;

a power source for supplying an alternating current to the coil, the coil including a core and a winding provided near the bulb; and further comprising:

startability improving means for improving startability of the lamp by generating a portion in which the alternating magnetic field generated by the coil is intensified in the bulb, wherein the startability improving means includes a high permeability member including a soft magnetic material near the core, and wherein the high permeability member is provided in the bulb.

2. The electrodeless discharge lamp according to claim 1, wherein the coil is inserted in a cavity provided in the bulb.

3. The electrodeless discharge lamp according to claim 1, further comprising a phosphor applied onto an inner surface of the bulb.

4. The electrodeless discharge lamp according to claim 1, wherein the luminous material comprises mercury and a rare gas.

5. The electrodeless discharge lamp according to claim 1, wherein the high permeability member is a magnetic thin film provided on a surface of the bulb.

6. An electrodeless discharge lamp, comprising:

a translucent bulb enclosing a luminous material;

a coil for generating an alternating magnetic field that causes discharge in the luminous material;

a power source for supplying an alternating current to the coil, the coil including a core and a winding provided near the bulb; and startability improving means for improving startability of the lamp by generating a portion in which the alternating magnetic field generated by the coil is intensified in the bulb, wherein the startability improving means includes a high permeability member including a soft magnetic material near the core, wherein the high permeability member is plate-shaped and is inserted between the power source and the bulb, and wherein the plate-shaped high permeability member has an asymmetric shape in which it is not symmetric with respect to a central axis of the core.

7. The electrodeless discharge lamp according to claim 6, wherein the plate-shaped high permeability member has a circular plate-like shape.

8. The electrodeless discharge lamp according to claim 7, wherein a center of a circle of the circular plate-shaped high permeability member is positioned in a portion other than a central axis of the core.

9. The electrodeless discharge lamp according to claim 6, wherein the high permeability member has at least one protrusion, recess or notch.

10. An electrodeless discharge lamp, comprising:

a translucent bulb enclosing a luminous material;

a coil for generating an alternating magnetic field that causes discharge in the luminous material;

a power source for supplying an alternating current to the coil, the coil including a core and a winding provided near the bulb; and further comprising:

startability improving means for improving startability of the lamp by generating a portion in which the alternating magnetic field generated by the coil is intensified in the bulb, wherein the startability improving means includes the coil in which a winding density of the winding wound around the core is sparse on a side of the power source and is dense on a side opposite to the power source.

11. An electrodeless discharge lamp, comprising:

a translucent bulb enclosing a luminous material;

a coil for generating an alternating magnetic field that causes discharge in the luminous material;

a power source for supplying an alternating current to the coil, the coil including a core and a winding provided near the bulb; and further comprising:

startability improving means for improving startability of the lamp by generating a portion in which the alternating magnetic field generated by the coil is intensified in the bulb, wherein the startability improving means includes the coil in which cross-section areas of the core are different along a central axis of the core.

12. An electrodeless discharge lamp, comprising:

a translucent bulb enclosing a luminous material;

a coil for generating an alternating magnetic field that causes discharge in the luminous material;

a power source for supplying an alternating current to the coil, the coil including a core and a winding provided near the bulb and further comprising:

startability improving means for improving startability of the lamp by generating a portion in which the alternating magnetic field generated by the coil is intensified in the bulb, wherein the startability improving means includes the coil provided with the core made of two or more magnetic materials having different magnetic permeabilities.

13. The electrodeless discharge lamp according to claim 5, wherein the coil is inserted in a cavity provided in the bulb.

14. The electrodeless discharge lamp according to claim 5, further comprising a phosphor applied onto an inner surface of the bulb.

15. The electrodeless discharge lamp according to claim 5, wherein the luminous material comprises mercury and a rare gas.

* * * * *

UNITED STATES PATENT AND TRADEMARK OFFICE

CERTIFICATE OF CORRECTION

PATENT NO. : 6,653,783 B2
DATED : November 25, 2003
INVENTOR(S) : Mitsuharu Kawasaki et al.

It is certified that error appears in the above-identified patent and that said Letters Patent is hereby corrected as shown below:

Title page,
Item [75], Inventors, "Mitsuharu Kawasaki, Kadoma (JP)" should be -- Mitsuharu Kawasaki, Osaka (JP) --.
"Toshiaki Kurachi, Hirakata (JP)" should be -- Toshiaki Kurachi, Osaka (JP) --
"Koji Miyazaki, Hirakata (JP)" should be -- Koji Miyazaki, Osaka (JP) --
"Kiyoshi Hashimotodani, Takatsuki (JP)" should be -- Kiyoshi Hashimotodani, Osaka (JP) --
Item [56], References Cited, FOREIGN PATENT DOCUMENTS, insert

| | | |
|---|---|---|
| -- JP | 2001-093687 A | 9/1999 |
| JP | 55-173859 A | 5/1954 |
| JP | 53137577 A | 5/1977 |
| JP | 11213957 A | 1/1998 |
| JP | 11040110 A | 7/1997 -- |

Column 15,
Line 65, "includes" should be -- is constituted by providing --

Column 16,
Line 26 "includes" should be -- is constituted by providing --
Line 54, "includes" should be -- is constituted by--

Column 17,
Line 3, "includes" should be -- is constituted by --

Column 18,
Line 2, "includes" should be -- is constituted by --

Signed and Sealed this

Nineteenth Day of October, 2004

JON W. DUDAS
*Director of the United States Patent and Trademark Office*